US008150278B2

(12) United States Patent
Satoh et al.

(10) Patent No.: US 8,150,278 B2
(45) Date of Patent: Apr. 3, 2012

(54) IMAGE FORMING APPARATUS INCLUDING A SOUND SENSOR TO DETERMINE CLEANING FAILURE

(75) Inventors: Osamu Satoh, Kanagawa (JP); Yasushi Nakazato, Tokyo (JP); Kohji Ue, Kanagawa (JP); Masahide Yamashita, Tokyo (JP); Jun Yamane, Kanagawa (JP); Shokichiro Hino, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 467 days.

(21) Appl. No.: 12/355,116

(22) Filed: Jan. 16, 2009

(65) Prior Publication Data

US 2009/0190939 A1 Jul. 30, 2009

(30) Foreign Application Priority Data

Jan. 30, 2008 (JP) ..... 2008-019339

(51) Int. Cl.
*G03G 21/00* (2006.01)
*G03G 15/00* (2006.01)

(52) U.S. Cl. ..... 399/34; 399/9

(58) Field of Classification Search ..... 399/9, 34, 399/71, 343, 350
See application file for complete search history.

(56) References Cited

U.S. PATENT DOCUMENTS

| | | | | |
|---|---|---|---|---|
| 7,110,917 | B2 | 9/2006 | Matsuura et al. | |
| 7,457,550 | B2 * | 11/2008 | Shoji et al. | 399/9 |
| 7,502,570 | B2 * | 3/2009 | Nishimura | 399/9 X |

FOREIGN PATENT DOCUMENTS

| | | |
|---|---|---|
| JP | 2003-295707 | * 10/2003 |
| JP | 2004-226482 | 8/2004 |
| JP | 2006-106017 | 4/2006 |

* cited by examiner

*Primary Examiner* — Sandra Brase
(74) *Attorney, Agent, or Firm* — Oblon, Spivak, McClelland, Maier & Neustadt, L.L.P.

(57) ABSTRACT

In an image forming apparatus, a cleaning blade cleans residual toner adhered on the surface of an image carrier and a sound sensor collects a sound generated inside a casing of the image forming apparatus. A determining unit determines, based on the sound collected by the sound sensor, whether cleaning failure has occurred in the cleaning blade. The determining unit makes the determination based on at least intensity of a first sound component that is a sound component of a first frequency and intensity of a second sound component that is a sound component of a second frequency different from the first frequency.

15 Claims, 12 Drawing Sheets

IMAGE FORMING APPARATUS INCLUDING A SOUND SENSOR TO DETERMINE CLEANING FAILURE

CROSS-REFERENCE TO RELATED APPLICATIONS

The present application claims priority to and incorporates by reference the entire contents of Japanese priority document 2008-019339 filed in Japan on Jan. 30, 2008.

BACKGROUND OF THE INVENTION

1. Field of the Invention

The present invention relates to a technology for cleaning toner from an image carrier in an image forming apparatus.

2. Description of the Related Art

In image forming apparatuses such as a photocopier, a facsimile, and a printer, noise can be caused when a cleaning blade, which cleans a surface of an image carrier, or a driving motor, which generates driving force to drive the image carrier and the like, deteriorates. Such a cleaning blade and a driving motor that have deteriorated should be replaced with new ones. This is because there is a high possibility that a normal operation becomes impossible with those parts and if the apparatus is kept being used without changing those parts, the image carrier or members in a driving transmission system can be damaged. The high-pitched large noise generated from a deteriorated cleaning blade is called blade noise.

Meanwhile, in Japanese Patent Application Laid-open No. 2004-226482, an image forming apparatus has been proposed that detects an abnormal part based on a result obtained by collecting sound generated inside the apparatus with a microphone as a sound sensor and that informs of an abnormal part in the apparatus. Specifically, the image forming apparatus analyzes intensity of each of sound components having certain frequencies f1, f2, f3, and f4 different from each other among sound components having frequencies different from each other included in sound obtained by the microphone. When the intensity of the sound component having frequency f1 exceeds a preset value, the apparatus assumes that a first motor that generates sound having frequency f1 during the operation is in an abnormal state, and displays a message to inform the same. Similarly, when the intensity of the sound components of frequencies f2 and f3 exceeds the preset value, the apparatus assumes that a second motor and a third motor are in an abnormal state, and displays a message informing the same. Moreover, when the intensity of the sound component having frequency f4 that is generated by friction between a photoconductor serving as the image carrier and a cleaning blade exceeds the preset value, the apparatus assumes that the blade noise is caused, and displays a message informing the same. Such a configuration enables to urge a user to replace those parts by informing an abnormal state when the blade noise occurs or various kinds of motors are in an abnormal state.

However, in the image forming apparatus, cleaning failure cannot be accurately detected as an abnormal state caused by deterioration of the cleaning blade. Specifically, the main cause of the blade noise is excessive friction between the blade and the photoconductor due to increased abutting area of the blade with the photoconductor caused by seriously worn edge of the cleaning blade. As friction excessively increases, relatively large high-pitched rubbing noise is generated. On the other hand, cleaning failure occurs when toner on the image carrier escapes through the abutting part between the image carrier and the blade in a state where the blade and the image carrier are in poor contact because of partial wear or deterioration of the blade. Because this is caused by partial poor contact between the blade and the image carrier, it is often the case that the blade noise is not generated. Furthermore, even if the blade noise occurs, it does not necessarily mean cleaning failure is caused. Therefore, the image forming apparatus described in Japanese Patent Application Laid-open No. 2004-226482 cannot detect cleaning failure accurately.

SUMMARY OF THE INVENTION

It is an object of the present invention to at least partially solve the problems in the conventional technology.

According to an aspect of the present invention, there is provided an image forming apparatus including an image carrier that carries a toner image; a transfer unit that transfers the toner image from a surface of the image carrier to a transfer medium; a cleaning blade that cleans residual toner adhered on the surface while abutting with the surface that has passed the transfer unit; a sound sensor that collects a sound generated inside a casing of the image forming apparatus; and a determining unit that determines, based on the sound collected by the sound sensor, whether cleaning failure has occurred in the cleaning blade based on at least intensity of a first sound component that is a sound component of a first frequency and intensity of a second sound component that is a sound component of a second frequency different from the first frequency.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments according to the present invention will be explained below in detail with reference to the accompanying drawings. A copier that forms images by electrophotography is taken below as an example of the image forming apparatus to explain the present invention.

Figure 1:
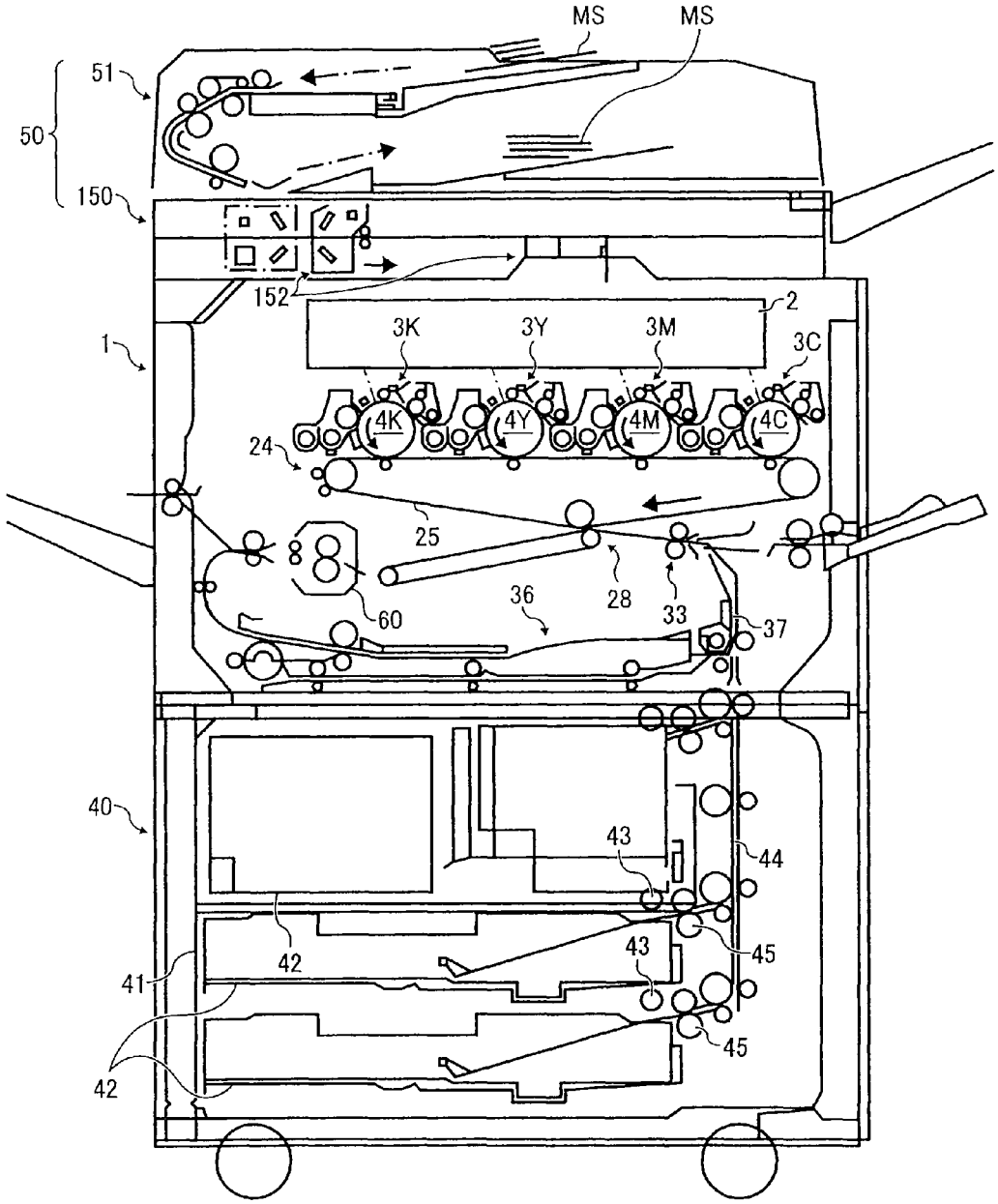
FIG. 1 is a schematic configuration diagram of a copier according to an embodiment of the present invention.

First, a basic configuration of the copier according to an embodiment of the present invention is explained. FIG. 1 is a schematic configuration diagram of the copier. The copier includes a printer unit 1, a blank-paper supply device 40, and an original conveying/reading unit 50. The original conveying/reading unit 50 includes a scanner serving as an original reading device that is fixed on the printer unit 1 and an auto document feeder (ADF) 51 serving as an original conveying device that is supported thereby.

The blank-paper supply device 40 includes two paper feeing cassettes 42 that are arranged in multistage inside a paper bank 41, a sending roller 43 that sends out recording paper from the paper feeding cassette, and a separating roller 45 that separates recording paper sent out to provide to a paper feeding path 44, and the like. In addition, the blank-paper supply device 40 includes a plurality of conveying rollers that convey recording paper to a paper feeding path 37 of the printer unit 1, and the like. The blank-paper supply device 40 thus supplies recording paper inside the paper feeding cassette to the paper feeding path 37 in the printer unit 1.

Figure 2:
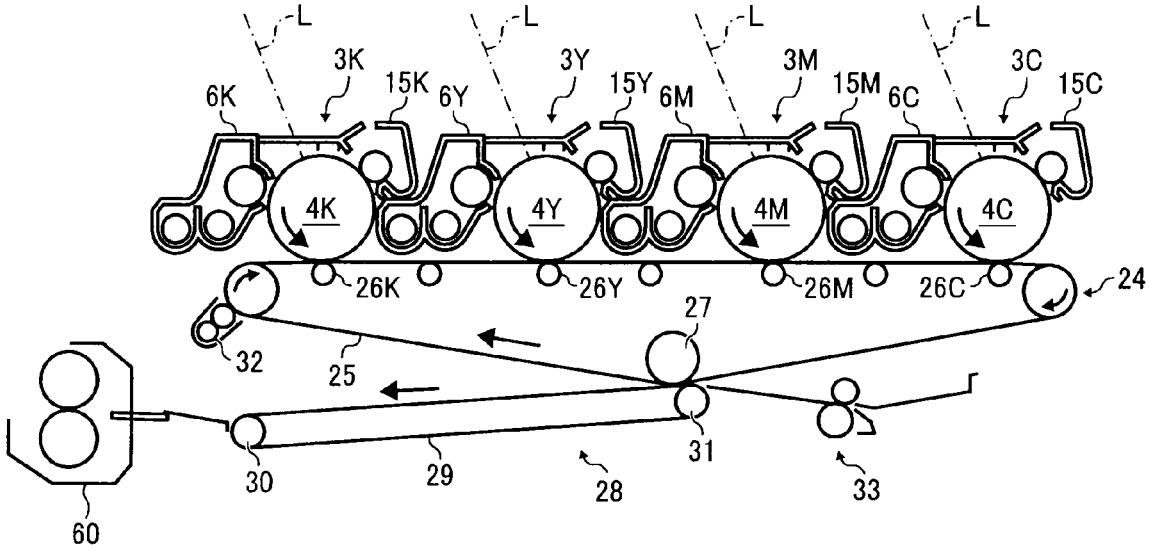
FIG. 2 is a partial enlarged configuration diagram of a part of an internal configuration of a printer unit in the copier.

FIG. 2 is a partial enlarged configuration diagram of a part of an internal configuration of the printer unit 1. The printer unit 1 includes an optical writing device 2, four process units 3K, 3Y, 3M, and 3C that form toner images in colors of K (black), Y (yellow), M (magenta), and C (cyan), respectively, a transfer unit 24, a paper conveying unit 28, a pair of registration rollers 33, a fixing unit 60, and the like. The printer unit 1 drives a light source (not shown), such as a laser diode and a light emitting device (LED), that is arranged in the optical writing device 2 to irradiate laser light L toward drum-shaped four photoconductors 4K, 4Y, 4M, and 4C. When the light source irradiate the laser light L, an electrostatic latent image is formed on a surface of each of the photoconductors 4K, 4Y, 4M, and 4C that serve as the image carriers. This latent image is then developed into a toner image by being subjected to predetermined development processes. Characters K, Y, M, and C added after reference numerals indicate that respective parts are for respective colors of black, yellow, magenta, and cyan.

The process units 3K, 3Y, 3M, and 3C are respectively configured to be one unit including a photoconductor serving as a latent image carrier and various kinds of devices arranged therearound. The process units 3K, 3Y, 3M, and 3C are supported by a common support, and are attachable and detachable to and from a main body of the printer unit 1. For example, the process unit 3K for black includes, besides the photoconductor 4K, a developing device 6K to develop an electrostatic latent image formed on the surface of the photoconductor 4K to a black toner image. Furthermore, the process unit 3K includes a drum cleaning device 15 that cleans residual toner adhered to the surface of the photoconductor 4K after passing through a primary transfer nip for color K described later. The copier has a so-called tandem configuration in which the four process units 3K, 3Y, 3M, and 3C are arranged opposite to an intermediate transfer belt 25 described later so as to be aligned along a direction of movement of the intermediate transfer belt 25 that is an endless belt.

Figure 3:
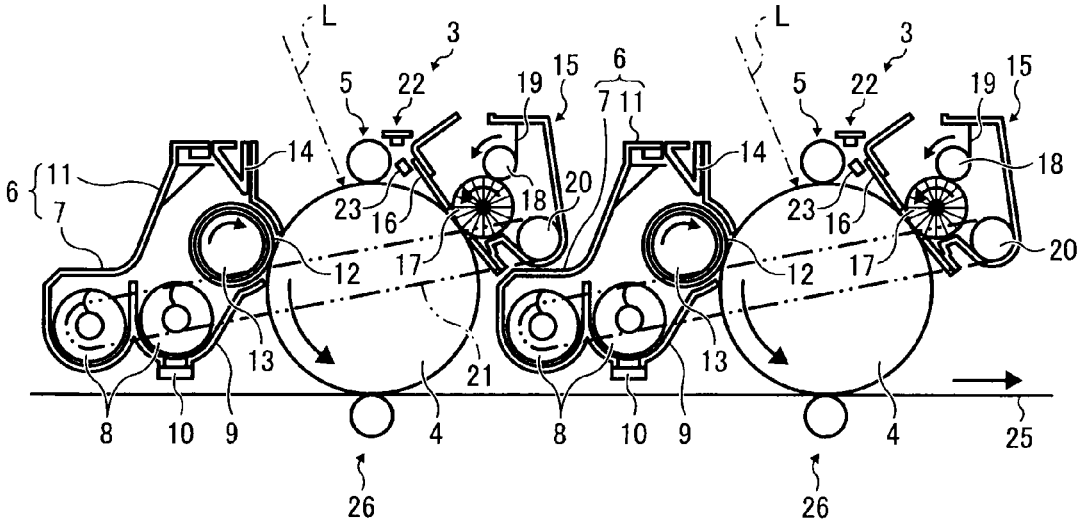
FIG. 3 is a partial enlarged diagram of a part of a tandem part in the copier.

FIG. 3 is a partial enlarged diagram of a part of a tandem part configured with the four process units 3K, 3Y, 3M, and 3C. The four process units 3K, 3Y, 3M, and 3C have substantially the same configuration except color of toner used therein. Therefore, the characters K, Y, M, and C added to respective numerals are omitted in FIG. 3. As shown in FIG. 3, the process unit 3 includes a charging roller 5, a developing device 6, the drum cleaning device 15, a charge removing lamp 22, and the like around a photoconductor 4.

As the photoconductor 4, a drum-shaped member is used that is formed with a tube made from aluminum or the like on which a photosensitive layer is formed by applying an organic photosensitive material having photosensitivity. An endless belt member can be used instead of the drum-shaped photoconductor 4.

The developing device 6 develops a latent image using a two-component developer (not shown) containing magnetic carrier and non-magnetic carrier. The developing device 6 includes a mixing unit 7 that conveys the two-component developer contained therein to provide to a developing sleeve 12 while mixing the two-component developer, and a developing unit 11 to transfer toner in the two-component developer carried by the developing sleeve 12 to the photoconductor 4. A single component developer, i.e., a developer that does not contain magnetic carrier, can be used instead of the two-component developer.

The mixing unit 7 is arranged below the developing unit 11, and includes two conveying screws 8 arranged parallel to each other, a partition plate arranged between the screws, a toner concentration sensor 10 arranged at the bottom of a developing case 9, and the like.

The developing unit 11 includes the developing sleeve 12 that is opposite to the photoconductor 4 through an opening of the developing case 9, a magnet roller 13 that is arranged therein unrotatably, a doctor blade 14 that is arranged such that an end thereof is close to the developing sleeve 12, and the like. The developing sleeve is a non-magnetic rotatable cylinder. The magnet roller 13 has a plurality of magnetic poles that aligns sequentially in a rotating direction of a sleeve from an opposite position to the doctor blade 14. These magnetic poles respectively act the magnetic force on the two-component developer on the sleeve at a predetermined position in the rotating direction. Thus, the two-component developer sent from the mixing unit 7 is attracted to the surface of the developing sleeve 12 to be carried thereon, and a magnetic brush along a magnetic line is formed on the surface of the sleeve.

The magnetic brush is controlled to have an appropriate layer thickness when the magnetic brush passes an opposite position to the doctor blade 14 along the rotation of the developing sleeve 12, to be conveyed to a developing area that is opposite to the photoconductor 4. By the potential difference between a developing bias applied to the developing sleeve 12 and an electrostatic latent image on the photoconductor 4, toner is transferred onto the electrostatic latent image, to contribute to development. Further, toner is returned to the inside of the developing unit 11 along the rotation of the developing sleeve 12, and after separated from the surface of the sleeve by the effect of a repulsive magnetic field formed between the magnetic poles of the magnet roller 13, the toner is returned to the inside of the mixing unit 7. In the mixing unit 7, an appropriate amount of toner is supplied to the two-component developer based on a result of detection by the toner concentration sensor 10.

On the photoconductors 4K, 4Y, 4M, and 4C of the four process units 3K, 3Y, 3M, and 3C shown in FIG. 2, K, Y, M, and C toner images are formed by the processes explained above.

The transfer unit 24 is arranged below the four process units 3K, 3Y, 3M, and 3C. The transfer unit 24 rotates the intermediate transfer belt 25 that is held in a stretched manner with a plurality of rollers so that the intermediate transfer belt 25 endlessly moves in a clockwise direction in FIG. 3 while contacting the photoconductors 4K, 4Y, 4M, and 4C. Thus, the primary transfer nips for K, Y, M, and C are formed at which the photoconductors 4K, 4Y, 4M, and 4C and the intermediate transfer belt 25 abut against each other. Near the primary transfer nips for K, Y, M, and C, the intermediate transfer belt 25 is pushed toward the photoconductors 4K, 4Y, 4M, and 4C by primary transfer rollers 26K, 26Y, 26M, and 26C arranged inside the loop of the belt. To these primary transfer rollers 26K, 26Y, 26M, and 26C, a primary transfer bias is applied by a power source (not shown). This forms a primary transfer electric field to transfer the toner images on the photoconductors 4K, 4Y, 4M, and 4C to the intermediate transfer belt 25 being a transfer body, on the primary transfer nips for K, Y, M, and C. On an outer surface of the intermediate transfer belt 25 that sequentially passes the primary transfer nips for K, Y, M, and C along the endless movement in the clockwise direction in FIG. 3, the toner images are sequentially superimposed at the respective primary transfer nips, thereby performing the primary transfer. By the primary transfer of this superimposition, a four-color superimposed toner image (hereinafter, "four color toner image") is formed on the outer surface of the intermediate transfer belt 25.

With reference to FIG. 3, on the surface of the photoconductor 4 after passing through the primary transfer nip, residual toner not used in the primary transfer to the intermediate transfer belt 25 is left behind. This residual toner is removed, or scrapped, from the surface of the photoconductor 4 by the drum cleaning device 15 of the process unit 3.

As the drum cleaning device 15, such a device that removes residual toner from the surface of the photoconductor 4 after passing through the primary transfer nip, by scraping with a cleaning blade 16 made of polyurethane rubber abutting on the photoconductor 4 is used. The cleaning blade 16 is fixed (hot-melted) on a metallic supporting member that is fixed to a casing of the process unit 3, and is arranged to abut against the photoconductor 4 in a counter direction. The counter direction is such a direction of the blade that an end of the cleaning blade that is supported in a cantilever state by the supporting member is positioned upstream compared to a rear end (free end) thereof in the direction of rotation of the photoconductor 4.

In the drum cleaning device 15, a cleaning brush roller 17 that cleans a portion that has just passed the abutting part with the cleaning blade 16 on the surface of the photoconductor 4 is further provided to enhance the cleaning property. The cleaning roller brush 17 includes a rotation axis member that is rotation driven and a brush roller that is formed with a lot of hairs napped around the rotation axis member. The cleaning roller brush 17 removes extraneous matters such as paper dust adhered to the surface of the photoconductor 4 by scrubbing the photoconductor 4 with the rotating brush roller. Moreover, the cleaning brush roller 17 also functions to lower the coefficient of the friction on the surface of the photoconductor 4 by applying pulverized lubricant on the surface of the photoconductor 4 while scraping the lubricant from a solid lubricant (not shown).

The residual toner that has been scraped off from the surface of the photoconductor 4 by the cleaning blade 16 is caught inside the brush of the cleaning brush roller 17 that is positioned at a side at the end of the blade. To the cleaning brush roller 17, a metallic electric field roller 18 abuts to which a bias having inverse polarity to the charged polarity of toner is applied. The residual toner that is caught inside the brush of the cleaning brush roller 17 moves to the surface of the electric field roller 18 that rotates while contacting the cleaning brush roller 17. The toner is scraped off from the electric field roller 18 by a scraper 19 that abuts on the electric field roller 18, and then falls on a collecting screw 20. The collecting screw 20 conveys collected toner toward an end in a direction perpendicular to the surface of the drum cleaning device 15 shown in FIG. 2, and gives the toner to an external recycle conveying device 21. The recycle conveying device 21 recycles the received toner by sending it to the drum cleaning device 15.

The charge removing lamp 22 removes electric charges of the photoconductor 4 by irradiating light. The surface of the photoconductor 4 from which the electric charges are removed is uniformly charged by the charging roller 5 that discharges electricity between the charging roller 5 and the photoconductor 4 by application of a charged bias, and then subjected to an optical writing process by the optical writing device 2. As the charging unit to uniformly charge the photoconductor 4, instead of the charging roller, a scorotron charger that performs a charge process without contacting the photoconductor 4 or the like can be used.

With reference to FIG. 2, below the transfer unit 24 in the drawing, the paper conveying unit 28 is provided that moves, in an endless manner, an endless paper conveying belt 29 wound therearound between a driving roller 30 and a secondary transfer roller 31. The intermediate transfer belt 25 and the paper conveying belt 29 are sandwiched between the secondary transfer roller 31 and a bottom tension roller 27 of the transfer unit 24. Thus, a secondary transfer nip at which the outer surface of the intermediate transfer belt 25 and an outer surface of the paper conveying belt 29 abut with each other is formed. A secondary transfer bias is applied to the secondary transfer roller 31 by a power source (not shown). On the other hand, the bottom tension roller 27 of the transfer unit 24 is grounded. Thus, a secondary transfer electric field is formed at the secondary transfer nip.

On the right side in FIG. 2 of the secondary transfer nip, the registration rollers 33 are arranged. The registration rollers 33 send recording paper sandwiched therebetween the rollers to the secondary transfer nip at such a timing where the recording paper is synchronized with the four-color toner image on the intermediate transfer belt 25 being a transfer medium. Inside the secondary transfer nip, the four-color toner image on the intermediate transfer belt 25 is secondary-transferred collectively onto the recording paper by effects of the secondary transfer electric field and the pressure of the nip so that a full color image is formed together with white color of the recording paper. The recording paper that has passed the secondary transfer nip is separated from the intermediate transfer belt 25 to be conveyed to the fixing unit 60 while being held on the outer surface of the paper conveying belt 29 by the endless movement thereof.

On the surface of the intermediate transfer belt 25 that has passed the secondary transfer nip, residual toner not transferred onto the recording paper at the secondary transfer nip is adhered. The residual toner is scraped away by a belt cleaning device 32 that abuts on the intermediate transfer belt 25.

The recording paper conveyed to the fixing unit 60 is processed to fix the full color image thereon by applying pressure and heat in the fixing unit 60, and then sent out from the fixing unit 60.

With reference to FIG. 1, a switchback device 36 is arranged below the paper conveying unit 28 and the fixing unit 60. This changes the direction of movement of the recording paper subjected to an image fixing process for one side to a direction of a recording-paper reversing device by a switching nail. The recording paper is reversed at the recording-paper reversing device and then enters the secondary transfer nip again. After the other side of the recording paper is subjected to the secondary transfer process and the fixing process, the recording paper is discharged on a paper discharge tray.

A scanner 150 that is fixed on the printer unit 1 includes a fixed reading unit and a movable reading unit 152 as a reading unit to read an image on an original MS. The fixed reading unit that has a light source, a reflection mirror, a charge coupled device (CCD), and the like is arranged right under a first exposure glass (not shown) fixed on an upper wall of a casing of the scanner 150 so as to contact the original MS. Light emitted from the light source is sequentially reflected on the surface of the original when the original MS that is conveyed by the ADF 51 passes on the first exposure glass, and the reflected light is received by an image reading sensor through a plurality of reflection mirrors. Thus, the original MS is scanned without moving an optical system constituted by the light source, the reflection mirrors, and the like.

On the other hand, the movable reading unit 152 is arranged right under a second exposure glass (not shown) fixed on the upper wall of the casing of the scanner 150 to contact the original MS, and on the right side in FIG. 1 of the fixed reading unit. The movable reading unit 152 can move an optical system constituted by a light source, a reflection mirror, and the like in right and left directions in FIG. 1. While moving the optical system in right and left directions, light emitted from the light source is reflected on an original (not shown) placed on the second exposure glass, and the reflected light is received by an image reading sensor fixed to the scanner main unit through a plurality of reflection mirrors. Thus, the original is scanned while moving the optical system.

Figure 4:
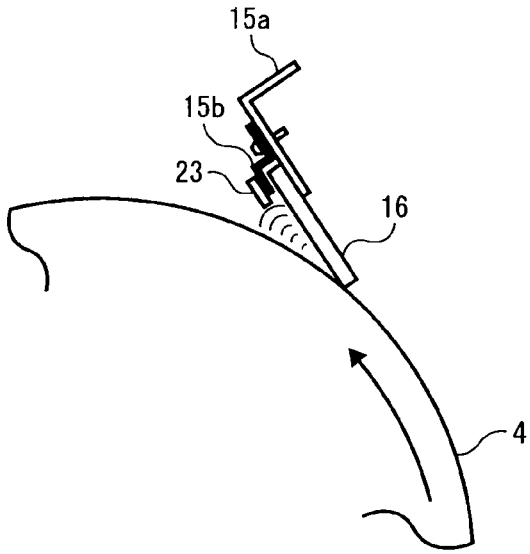
FIG. 4 is an enlarged configuration diagram of a cleaning blade in the copier and its peripheral configuration.

As shown in FIG. 3, a sound sensor 23 is arranged near the cleaning blade 16 in the process unit 3. FIG. 4 is an enlarged diagram of the cleaning blade 16 and a configuration therearound. The cleaning blade 16 is attached to a metallic supporting member 15*a* that is fixed to a casing of the drum cleaning device. To the supporting member 15*a*, a sensor bracket 15*b* that holds the sound sensor 23 is fixed with a screw or the like.

At the end of the cleaning blade 16 and a part at which the cleaning blade 16 and the photoconductor 4 abut with each other, a rubbing noise is generated when the blade rubs the rotating photoconductor 4. A wedge-shaped space is formed between a surface of the cleaning blade 16 on a photoconductor side and the photoconductor 4. The rubbing noise generated on a blade end side is reverberated in this wedge-shaped space to be detected by the sound sensor 23. An ultra-compact microphone manufactured by micro-electro-mechanical systems (MEMS) can be used as the sound sensor 23 so that the rubbing noise is captured in the small wedge-shaped space formed between the photoconductor 4 and the surface of the blade. Some other microphone can also be used.

The sound sensor 23 converts sound into an analog electric signal and outputs the analog electric signal. The analog electric signal is then converted into a digital electric signal by an analog/digital (A/D) converter (not shown), and sent to a control unit (not shown).

The transfer unit 24 functions as a transfer unit that transfers toner images on the surfaces of the photoconductors (4K, 4Y, 4C, 4M) of respective colors serving as an image carrier onto the intermediate transfer belt 25 serving as a transfer medium. Moreover, the transfer unit 24 functions as a transfer unit that transfers a toner image on the intermediate transfer belt 25 serving as an image carrier onto a recording paper P serving as a transfer medium.

Experiments conducted by the present inventors are explained next.

The present inventors prepared a test copier having the same configuration as the above copier. The inventors collected rubbing noise that is generated from the cleaning blade for K by the sound sensor (23) of the process unit for K (3K) during long-time continuous output of a predetermined monochrome test image by the copier, and conducted frequency analysis of the rubbing noise based on digital data thereof. The frequency analysis was performed using the fast Fourier transform (FFT). fs=48 kHz was used for a sampling frequency fs (sampling interval) of the rubbing noise, and a quantization bit was uncompressed value of 16 bits.

As shown in FIG. 3, near the cleaning blade 16 and the sound sensor 23, surrounding members that performs certain operations around the blade, such as the cleaning brush roller 17, the electric field roller 18, the collecting screw 20, and the like, are present. These members all generate noise during the operation, and if the noise is sensed by the sound sensor 23, analysis of the rubbing noise of the cleaning blade 16 becomes difficult. Therefore, in the continuous print test, the operation of such surrounding members was stopped.

Waveform data of the rubbing noise obtained by the frequency analysis was in a frequency band from 1 kilohertz to 15 kilohertz removing components in a band lower than 1 kilohertz in which an altitude change is large and components in a band exceeding 15 kilohertz that is the upper limit in a frequency characteristic of the sound sensor.

Figure 5:
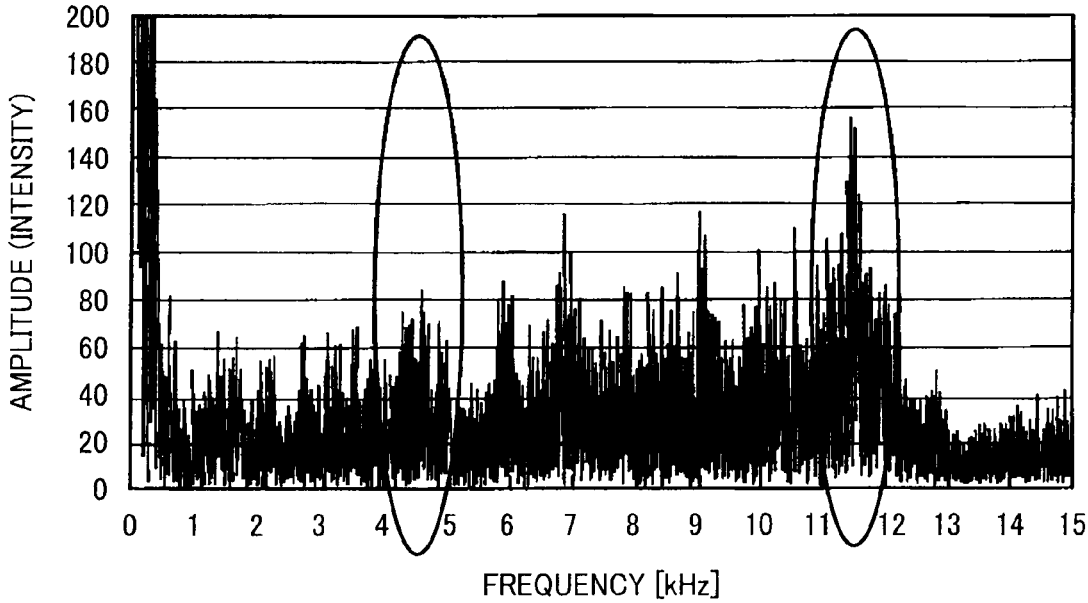
FIG. 5 is a graph of a frequency characteristic of rubbing noise at the beginning of a continuous print test.

FIG. 5 is a graph of a frequency characteristic of the rubbing noise at the beginning of the continuous print test. As shown in FIG. 5, at the beginning of the continuous print test, that is, when the cleaning blade is new, sound components from 11.5 kilohertz to 11.7 kilohertz were particularly large. On the other hand, sound components from 4.5 kilohertz to 4.7 kilohertz were not so large.

In the continuous print test, thereafter, a phenomenon that the sound components from 11.5 kilohertz to 11.7 kilohertz gradually decreased while the sound components of 4.5 kilohertz to 4.7 kilohertz gradually increased was recognized. After a while, cleaning failure occurred. Detection of the cleaning failure was conducted by collecting escaped toner adhered on the surface of the photoconductor immediately after passing the abutting part with the blade on an adhesive tape, and by observing the collected toner with a magnifying lens.

As the cleaning failure becomes worse, a phenomenon called filming starts to occur in which toner rubbed by an abutting part between the photoconductor and the blade sticks to the photoconductor in the form of a film-formed clump. If such filming occurs, the contact between the photoconductor and the blade is further degraded, and as a result, stains caused by the cleaning failure increases, or a white spot phenomenon occurs due to deterioration of image forming performance at a position at which the filming occurs on the photoconductor.

Figure 6:
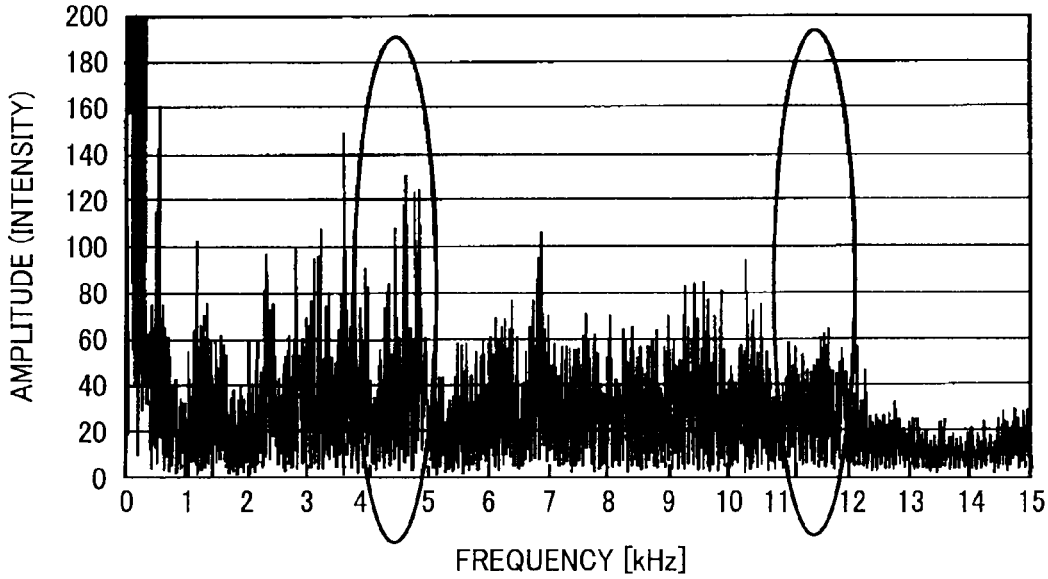
FIG. 6 is a graph of a frequency characteristic of rubbing noise at a stage where cleaning failure occurs.

FIG. 6 is a graph of a frequency characteristic of the rubbing noise at a stage in which the cleaning failure occurs. As shown in FIG. 6, at this stage, while the amplitude (intensity) of the sound components from 11.5 kilohertz to 11.7 kilohertz has decreased to about 40% of the amplitude at the beginning, the amplitude of the sound components from 4.5 kilohertz to 4.7 kilohertz has increased to about 160% of the amplitude at the beginning.

To test whether such a phenomenon is reproducible that the amplitude of the sound components from 4.5 kilohertz to 4.7 kilohertz gradually increases while the amplitude of the sound components from 11.5 kilohertz to 11.7 kilohertz gradually decreases with the increase of output sheets, the same continuous print test was conducted for a plurality of times. The same phenomenon was confirmed in most of the continuous print tests.

Next, the inventors acquired data on the relative intensity of the sound components from 11.5 kilohertz to 11.7 kilohertz and the sound components from 4.5 kilohertz to 4.7 kilohertz for waveform data at each timing obtained by each of the continuous print tests. As for the relative intensity, a peak value of the sound components from 11.5 kilohertz to 11.7 kilohertz and a peak value of the sound components from 4.5 kilohertz to 4.7 kilohertz were expressed relative to a value of 0.25, replacing the peak value of the sound components from 11.5 kilohertz to 11.7 kilohertz at the beginning of the test with the value 0.25. The reason why the relative intensity was used was as follows. The peak value of the sound components from 11.5 kilohertz to 11.7 kilohertz varies at each timing such as at the beginning of the test and a point at which the cleaning failure occurs, and relatively large difference was observed in each test. Also for the peak value of the sound components from 4.5 kilohertz to 4.7 kilohertz, relatively large difference was observed in each test. If the sound components are considered separately in each continuous print test, the peak values themselves can be used. However, for integrated consideration of the sound components, it is required to use the relative intensity.

Figure 7:
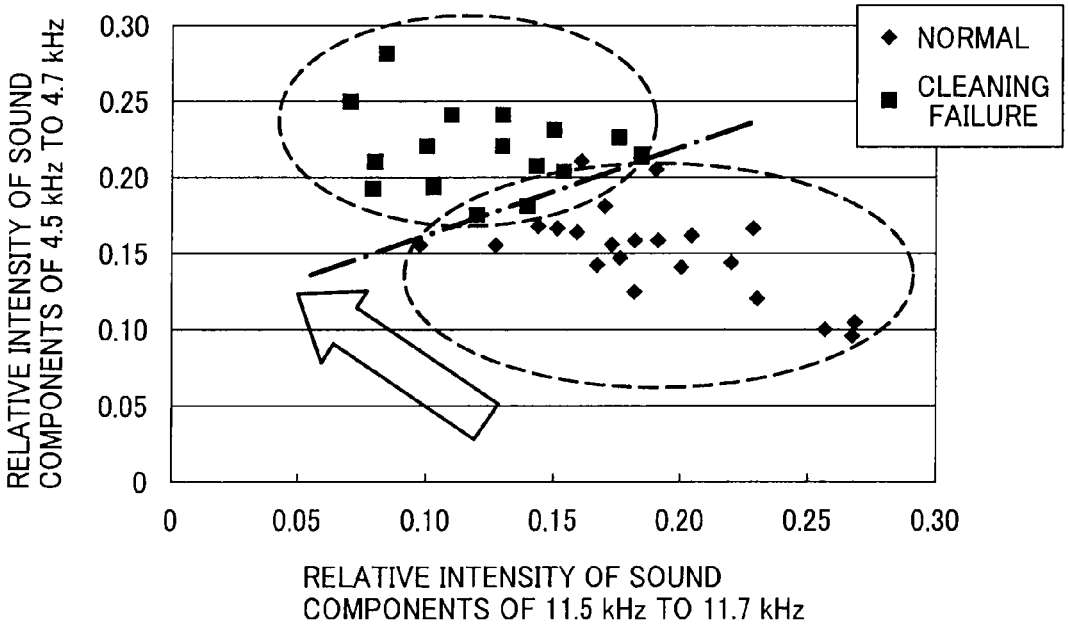
FIG. 7 is a graph of a relative intensity characteristic of a time-decreasing sound component and a time-increasing sound component of the blade rubbing noise.

The relative intensity characteristic in which the relative intensity of the sound components from 11.5 kilohertz to 11.7 kilohertz is expressed on an X axis in a two-dimensional coordinates and the relative intensity of the sound components from 4.5 kilohertz to 4.7 kilohertz is expressed on a Y axis is shown in FIG. 7. The sound components from 11.5 kilohertz to 11.7 kilohertz are referred to as time-decreasing sound components also. Furthermore, the sound components from 4.5 kilohertz to 4.7 kilohertz are referred to as time-increasing sound components also. As shown in FIG. 7, in the two-dimensional coordinates of the relative intensity, it is recognized that characteristic field is divided into two fields of a characteristic field in a state where the cleaning failure occurs and a characteristic field in a state where the cleaning failure has not occurred (normal) by a dashed-dotted line as a boundary. This shows that it can be determined that the cleaning failure occurs when a ratio of the relative intensities (time-increasing sound components/time-decreasing sound components, or the inverse) exceeds (or becomes below) a predetermined threshold.

In the copier used in the tests, a high-speed print mode and a low-speed print mode can be switched. The high-speed print mode was used in the continuous print test. Similarly, when the continuous print test was conducted in the low-speed print mode, the sound components of 4.5 kilohertz to 4.7 kilohertz gradually increased while the sound components from 11.5 kilohertz to 11.7 kilohertz gradually decreased. In the low-speed print mode, the photoconductor is rotated at a lower speed compared to the previous continuous print test. That is, the speed in which the cleaning blade rubs the photoconductor is slower. However, the similar results were observed in the sound components from 11.5 kilohertz to 11.7 kilohertz and the sound components from 4.5 kilohertz to 4.7 kilohertz. Therefore, the frequency band thereof was considered to be based on a natural oscillation of the cleaning blade.

Figure 8:
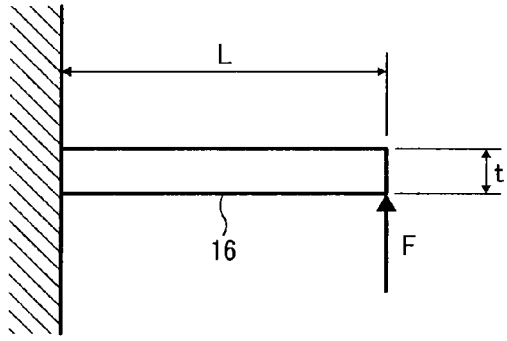
FIG. 8 is a schematic diagram of a blade support model to acquire natural oscillation.

The natural oscillation of the blade when abutting pressure F was applied in a direction indicated by an arrow in FIG. 8 while supporting the cleaning blade 16 in a cantilever state as shown in FIG. 8 was acquired. In FIG. 8, L indicates length of the cleaning blade. t indicates thickness of the cleaning blade.

A natural oscillation f in the oscillation engineering can be expressed as a following equation where m indicates the order:

$$fm=(\lambda m^2/2\pi)\cdot\sqrt{(E\cdot I/\rho\cdot w\cdot t)}$$

In this equation, λ=eigenvalue, E=Young's modulus, I=cross-section secondary moment, L=length of beam, w=width of beam, t=thickness of beam, ρ=density of member, and F=load on member.

In the cleaning blade 16, L=length of blade, w=width of blade, t=thickness of blade, ρ=density of blade, and F=load on blade.

The cross-section secondary moment I can be expressed as:

$$I=wt^3/12$$

The eigenvalue λ in the model shown in the same drawing can be expressed as an equation below:

$$\lambda m\cdot L\cdot\mu=(1+\cos\lambda mL\cdot\cos h\lambda mL)/(\sin\lambda mL\cdot\cos h\lambda mL-\cos\lambda mL\cdot\sin h\lambda mL)$$

A friction coefficient μ can be expressed as an equation below (g indicates gravity acceleration):

$$\mu=F/(\rho\cdot w\cdot t\cdot L\cdot g)$$

When calculated by substituting sizes of the cleaning blade 16 used in the continuous print test and test conditions in these equations, a value close to 4.6 kilohertz was obtained as a third-order component the natural oscillation. Moreover, a fourth-order component was a value close to 11.6 kilohertz. As a result, it was found that frequencies of the time-decreasing sound component and the time-increasing sound component of rubbing noise obtained in the continuous print tests were all natural oscillation of the cleaning blade 16.

Figure 9:
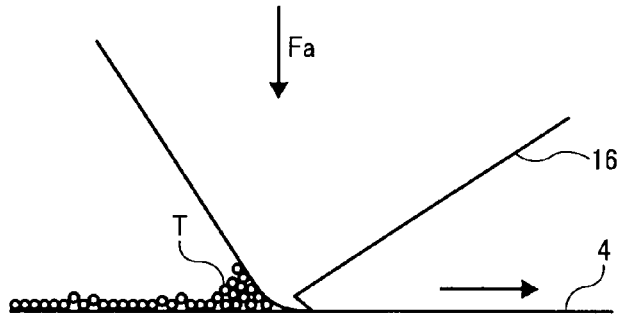
FIG. 9 is an enlarged schematic diagram of the cleaning blade in a brand-new state and the abutting part between the cleaning blade and the photoconductor.

FIG. 9 is an enlarged schematic diagram of the cleaning blade 16, which is brand-new, and the abutting part between the cleaning blade 16 and the photoconductor 4. In FIG. 9, the cleaning blade 16 is pressed to the photoconductor 4 by pressure Fa (same as in FIG. 10 and FIG. 11 described later). By the pressing, the edge portion at the end of the cleaning blade 16 and the photoconductor 4 abut against each other in an appropriate intimate condition, thereby scraping toner particles T caught at the abutting part off from the surface of the photoconductor 4. The edge portion is stretched to some extent toward downstream in a direction of surface movement when rubbed by the photoconductor 4 that makes the surface movement. The sound components from 11.5 kilohertz to 11.7 kilohertz are considered to be generated by subtle stick slip occurring in the stretched state.

Figure 10:
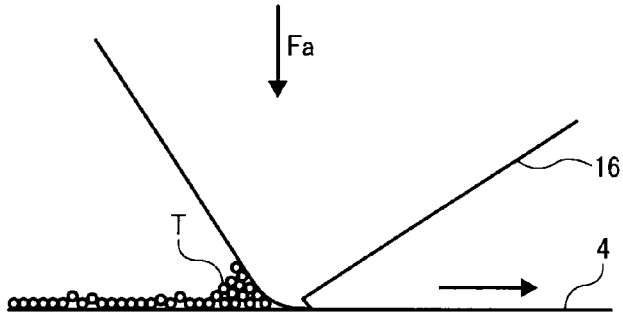
FIG. 10 is an enlarged schematic diagram of the abutting part of the cleaning blade that has slightly deteriorated with the photoconductor.

FIG. 10 is an enlarged schematic diagram of the cleaning blade 16, which has slightly deteriorated because of use, and the abutting part between the cleaning blade 16 and the photoconductor. When the cleaning blade 16 deteriorates, deformability of the edge portion at the end is degraded. As a result, a stretching amount of the edge portion toward downstream in the surface movement of the photoconductor decreases. It is considered that as the stretching amount gradually decreases, the amplitude of the sound components from 11.5 kilohertz to 11.7 kilohertz gradually decreases while the amplitude of the sound components from 4.5 kilohertz to 4.7 kilohertz gradually increases.

Figure 11:
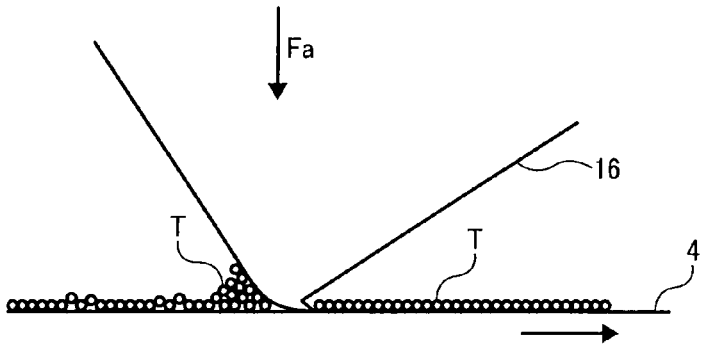
FIG. 11 is an enlarged schematic diagram of the cleaning blade that has deteriorated to an extent to cause cleaning failure and the abutting part between the cleaning blade and the photoconductor.

FIG. 11 is an enlarged schematic diagram of the cleaning blade 16, which has deteriorated to the extent to cause cleaning failure, and the abutting part between the cleaning blade 16 and the photoconductor 4. When the cleaning failure starts to occur, the toner particles T start to escape from the abutting part between the blade and the photoconductor 4, as shown in FIG. 11. Accordingly, a small amount of the toner particles T stay behind between the edge of the blade and the photoconductor 4. It is considered that this makes the stretching amount of the edge portion toward downstream in the direction of surface movement of the photoconductor further decrease, and the amplitude of the sound components from 4.5 kilohertz to 4.7 kilohertz further increase.

Figure 12:
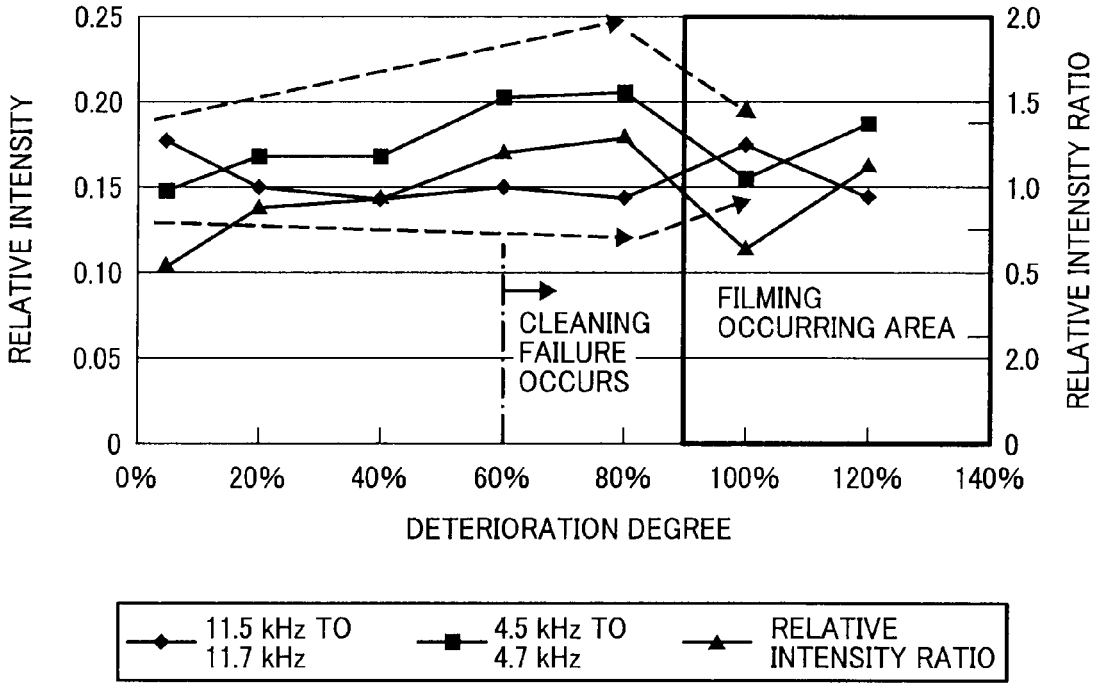
FIG. 12 is a graph of the time-decreasing sound component, the time-increasing sound component, and the relative intensity ratio that change with time when a brand-new cleaning blade is used 1.2 times longer than a designed life.

FIG. 12 is a graph of the time-decreasing sound component, the time-increasing sound component, and the relative intensity ratio that change with time when a brand-new cleaning blade is used 1.2 times longer than a designed life. For a deterioration degree on a horizontal axis in FIG. 12, a point at which a cumulative print operation time reaches the designed life is expressed as 100%. As shown in FIG. 12, when the deterioration degree reaches 60%, that is, when the cumulative print operation time reaches 60% of the designed life, the cleaning failure starts to occur. However, the cumulative print operation time at which the cleaning failure occurs generally depends on each product. Therefore, whether cleaning failure occurs cannot be determined based on the cumulative print operation time.

As shown in FIG. 12, until the point at which the cleaning failure occurs (the point at which the deterioration degree reaches 60%), while the intensity of the sound components from 11.5 kilohertz to 11.7 kilohertz decreases with time, the intensity of the sound components from 4.5 kilohertz to 4.7 kilohertz increases with time. The relative intensity ratio at the point at which the cleaning failure occurs is approximately 1.2 kilohertz. In the continuous print tests explained previously, there was not much difference in the relative intensity ratio at the points at which the cleaning failure occurs, and was approximately 1.2 kilohertz in any of the continuous print tests. Therefore, it is possible to determine that the cleaning failure has occurred when the relative intensity ratio exceeds a predetermined threshold.

If the operation is further continued after the cleaning failure occurs, without changing the cleaning blade, the time-decreasing sound component and the time-increasing sound component both show the same behavior as that observed until then, in a time band of the deterioration degree 60% to 80%. That is, while the sound components from 11.5 kilohertz to 11.7 kilohertz decrease with time, the sound components from 4.5 kilohertz to 4.7 kilohertz increase with time. However, from the point at which the deterioration degree exceeds 80%, an opposite behavior is observed in the time-decreasing sound component and the time-increasing sound component. That is, while the sound components from 11.5 kilohertz to 11.7 kilohertz increase with time, the sound components from 4.5 kilohertz to 4.7 kilohertz decrease with time. Accordingly, the relative intensity ratio, which has been increasing, starts to decrease.

Thereafter, if the operation is further continued, filming starts to occur on the photoconductor from the point at which the deterioration degree reaches about 90%, and then, both the time-decreasing sound component and the time-increasing sound component start to show the original behavior. That is, in a little while after filming starts to occur, the relative intensity ratio starts to increase with time again.

The reason why the relative intensity ratio changes the behavior from increase with time to decrease with time prior to occurrence of filming (deterioration degree=about 90%) is discussed below. The reason is that, immediately before filming starts to occur, friction between the photoconductor and the cleaning blade temporarily increase due to softening of toner present therebetween, to increase the stretching amount of the edge portion at the end of the blade in the direction of surface movement of the photoconductor temporarily.

As described above, because the relative intensity ratio keeps increasing with time until the cleaning failure starts to occur, the point at which the relative intensity ratio has increased (decreased, in the case that "time decrease/time increase" is employed) to a predetermined threshold can be regarded as a cleaning failure starting point. Filming starts to occur in a little while after the cleaning failure starts to occur, and the relative intensity ratio temporarily decreases right before filming occurs. Therefore, it is difficult to predict the occurrence of filming only by comparing the relative intensity ratio with the threshold. However, if a change of the relative intensity ratio with time is grasped, the occurrence of filming can be predicted. Specifically, by detecting the change of behavior of the relative intensity ratio from increase with time to decrease with time, it is possible to predict that filming starts to occur shortly.

The reason why the behavior of the relative intensity ratio returns to increase with time to decrease with time in a while after filming starts to occur is discussed below. The reason is that, friction force between the photoconductor and the blade starts to decrease again as filming develops to some extent to increase the hardness.

Next, concrete examples of the configuration of the copier according to the embodiment are explained.

Figure 13:
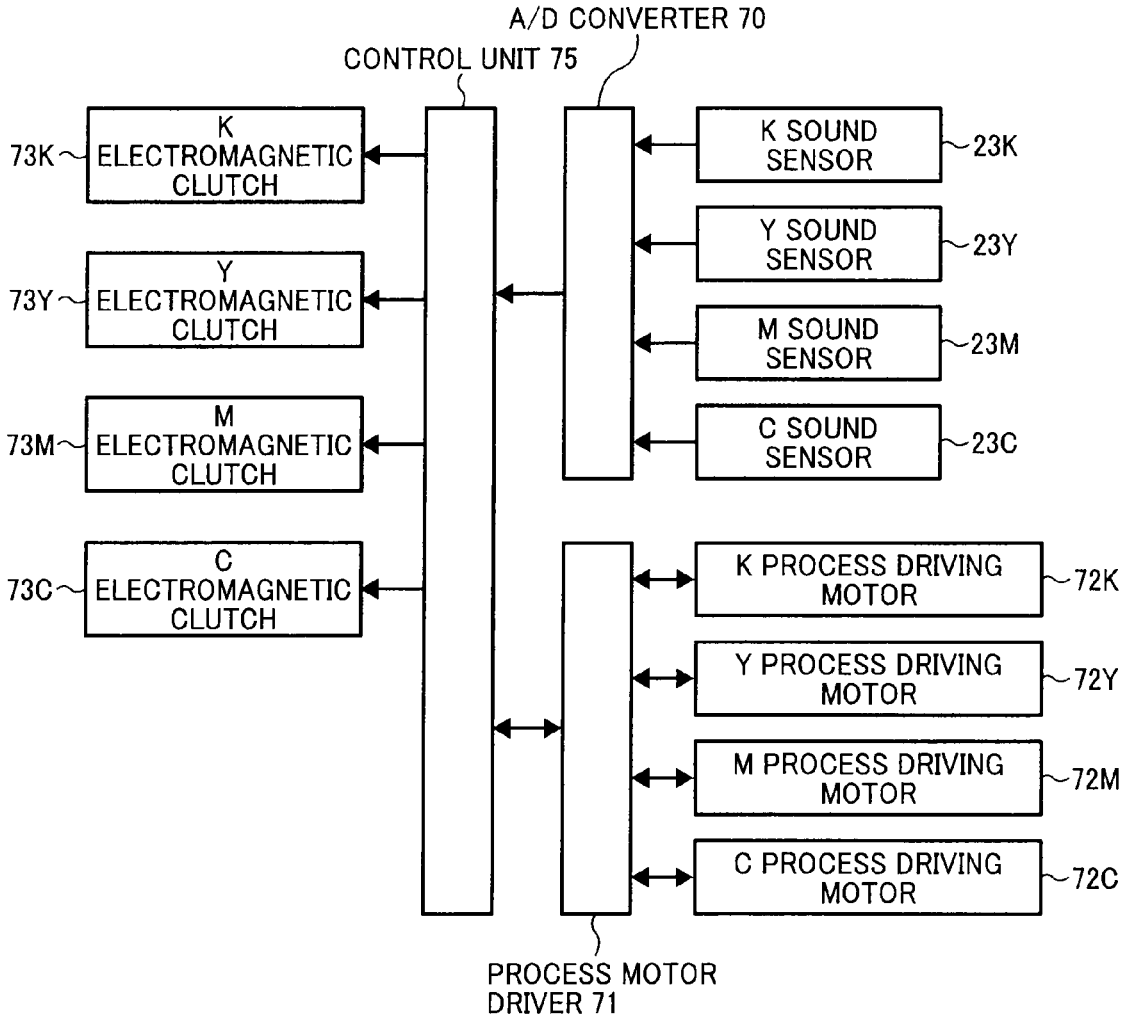
FIG. 13 is a block diagram of a part of an electric circuit in the printer unit of the copier.

FIG. 13 is a block diagram of a part of an electric circuit in the printer unit 1 of the copier. As shown in FIG. 13, a control unit 75 integrally controls driving of each device in the printer unit, and includes a central processing unit (CPU) as an operating unit, a read only memory (ROM) that stores a control program, a random access memory (RAM) that temporarily stores data, a nonvolatile flash memory, and the like.

To the control unit 75, the sound sensors (23K, 23Y, 23C, 23M) in the process units of respective colors are connected through an A/D converter 70. The rubbing noise of the cleaning blade in the process unit of respective colors is captured by the sound sensors 23K, 23Y, 23C, and 23M, and then converted into a digital signal by the A/D converter 70 to be sent to the control unit 75.

K, Y, M, and C process driving motors 72K, 72Y, 72C, and 72M in FIG. 13 are used as a driving source of each member in the respective process units for K, Y, M, and C. These driving motors are connected to the control unit 75 through a process motor driver 71, and the driving thereof is controlled by the control unit 75.

K, Y, M, and C electromagnetic clutches 73K, 73Y, 73M, and 73C in FIG. 13 transmit or shut the transmission of driving force to a part of members in the respective process units for K, Y, M, and C, and the driving thereof is controlled by the control unit 75.

Figure 14:
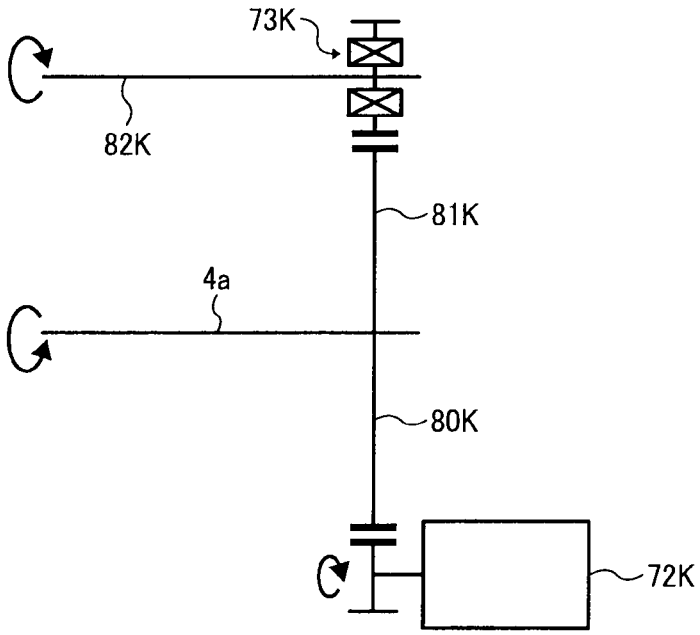
FIG. 14 is a connection diagram of a drive transmission mechanism in a process unit for K in the copier.

FIG. 14 is a connection diagram of a drive transmission mechanism in the process unit for K. For the process unit (3K) for K, each member therein is driven by the driving force of the K process driving motor 72K as described above. The rotation driving force of the K process driving motor 72K is transmitted to a rotation axis 4*a* of the photoconductor for K through a first driving transmission system 80K constituted by gears and the like. Thus, the photoconductor for K (4K) is driven to rotate. The process units for the other colors have the same or similar configuration.

To the first driving transmission system 80K, a second driving transmission system 81K constituted by gears and the like, the K electromagnetic clutch 73K described above, and a third driving transmission system 82K are sequentially connected. The K electromagnetic clutch 73K is of a normally closed type, and transfers the rotation driving force transmitted from the second driving transmission system 81K to the third driving transmission system 82K when it is not energized. Thus, the cleaning brush roller 17, the electric field roller 18, and the collecting screw 20 being surrounding members of the blade in the process unit for K are respectively driven to rotate. When the electromagnetic clutch 73K for K is energized (driving state), transmission of the rotation force of the second driving transmission system 81K to the third driving transmission system 82K is blocked. Therefore, in this state, even if the K process driving motor 72K rotates, the cleaning brush roller 17, the electric field roller 18, and the collecting screw 20 do not rotate. However, the rotation driving force is transmitted to the photoconductor.

The control unit 75 shown in FIG. 13 is configured to perform a determination-sound acquiring control at a predetermined timing such as right after a main switch (not shown) of the copier is turned on, each time a predetermined time passes, and each time a predetermined number of sheets are printed. The determination-sound acquiring control is such a control that the rubbing noise of the cleaning blade is sequentially captured and a waveform thereof is sequentially recorded on a flash memory (not shown) in the process units for K, Y, C, and M. Specifically, first, in a state where the K electromagnetic clutch 73K is driven, the K process driving motor 72K is driven. Thus, the photoconductor is driven to rotate in a state where the cleaning brush roller 17, the electric field roller 18, and the collecting screw 20 being the surrounding members are stopped in the process unit for K. Subsequently, digital data of the rubbing noise that is sent from the K sound sensor 23K through the A/D converter 70 is obtained, and the waveform of the rubbing noise is analyzed by FFT method. After performing the filtering process to remove sound components in frequency bands lower than 1 kilohertz and exceeding 15 kilohertz from the waveform, a result is written in a nonvolatile flash memory (not shown).

As described above, by obtaining the rubbing noise used to determine the cleaning failure in the state where the cleaning brush roller, the electric field roller, and the collecting screw are stopped, it is possible to avoid degradation of determination accuracy caused by operation sound of the surrounding members mixed therein.

Upon writing the waveform subjected to the filtering process in the flash memory, the control unit 75 drives the Y electromagnetic clutch 73Y and the Y process driving motor 72Y after stopping the driving of the K electromagnetic clutch 73K and the K process driving motor 72K. Similarly to the case of K, the waveform of the rubbing noise in the process unit for Y is then analyzed, and a result obtained after the filtering process is written in the flash memory. Thereafter, a similar process is performed also for the rubbing noise of the blade in each of the process units for M and C.

After the determination-sound acquiring control is finished, the control unit 75 performs a cleaning-failure determining process. In the cleaning-failure determining process, a peak operation value of the sound components from 11.5 kilohertz to 11.7 kilohertz is first calculated from the waveform of the rubbing noise of the blade in the process unit for K that is acquired by the determination-sound acquiring control just performed. Moreover, a peak operation value of the sound components from 4.5 kilohertz to 4.7 kilohertz is also calculated. Based on results of the calculation, the relative intensity of the sound components from 11.5 kilohertz to 11.7 kilohertz, the relative intensity of the sound components from 4.5 kilohertz to 4.7 kilohertz, and the relative intensity ratio are calculated, and then, stored in a relative intensity data table for K constructed in a flash memory to accumulate data from past cases. The relative intensity data table for K is to cumulatively record total usage time of the cleaning blade for K at the point of time when the determination-sound acquiring control is performed, the relative intensity of the sound components from 11.5 kilohertz to 11.7 kilohertz, the relative intensity of the sound components from 4.5 kilohertz to 4.7 kilohertz, and the relative intensity ratio in an associated manner. Also for Y, C, and M, a similar relative intensity data table is constructed in the flash memory.

Next, the control unit 75 determines whether the calculated relative intensity ratio exceeds a predetermined threshold. When the relative intensity ratio exceeds the threshold, the control unit 75 determines that the cleaning failure has occurred in the process unit for K, and displays an error message on a display unit (not shown) so as to inform the user that the cleaning failure has occurred. Some other method can be used to inform the user that the cleaning failure has occurred. Thereafter, it is proceeded to a determining process for the process unit for Y. On the other hand, when the relative intensity ratio does not exceed the predetermined threshold, it is proceeded to the determining process for the process unit for Y without displaying the error message on the display unit.

In the determining process for the process unit for Y, similarly to the process unit for K, the relative intensity of the sound components from 11.5 kilohertz to 11.7 kilohertz, the relative intensity of the sound components from 4.5 kilohertz to 4.7 kilohertz, and the relative intensity ratio are calculated for the rubbing noise of the blade in the process unit for Y, and then stored in the relative intensity data table for Y. It is determined whether the calculated relative intensity ratio exceeds the predetermined threshold, and when the relative intensity ratio exceeds the threshold, it is determined that the cleaning failure has occurred in the process unit for Y, and an error message informing the same is displayed on the display unit.

Thereafter, similar determination process is performed for the process units for C and M also. As described above, executing periodical determination whether cleaning failure has occurred for each of the process units for K, Y, C, and M, the occurrence of cleaning failure can be detected at an appropriate time.

For users who attach importance to high image quality, it is preferable that the cleaning blade be replaced as soon as possible when the cleaning failure occurs. However, among users who attach importance to low cost, there are some users who wish to continue using the cleaning blade although a cleaning failure has started to occur. For such users, an appropriate replacement time of the cleaning blade is the point of time when flaming starts to occur. If filming develops, not only degradation of the image quality, but also damage to the driving transmission systems or the photoconductor can be caused. Therefore, when filming starts to occur, it is preferable that the cleaning blade be replaced as soon as possible. However, if some period of time is required until replacement with a reason that there is no stock at a dealer, or the like, the driving transmission systems or the photoconductor can be damaged.

The control unit 75 performs a filming prediction process when the cleaning failure determining process is finished. In the filming prediction process, changes of sound components with time are analyzed for each of the process units for K, Y, C, and M based on data stored in the relative intensity data table for K, Y, C, and M in the flash memory as a storage unit. Specifically, a change in the relative intensity ratio with time is analyzed. The relative intensity ratio reflects a change in the relative intensity of the sound components from 11.5 kilohertz to 11.7 kilohertz with time and a change in the relative intensity of the sound components from 4.5 kilohertz to 4.7 kilohertz with time. Therefore, analysis of a change in the relative intensity ratio with time means analysis of a change in both sound components with time.

The control unit 75 determines whether a change of the behavior of the relative intensity ratio from increase with time to decrease with time after cleaning failure occurs is detected based on a result of analysis. When the change from increase with time to decrease with time is detected, the control unit 75 predicts that a filming occurrence timing of the process unit is approaching, and displays an error message indicating the same on the display unit. When the change from increase with time to decrease with time is detected, it is predicted that it still has some time until filming occurs, and the error message is not displayed.

Figure 15:
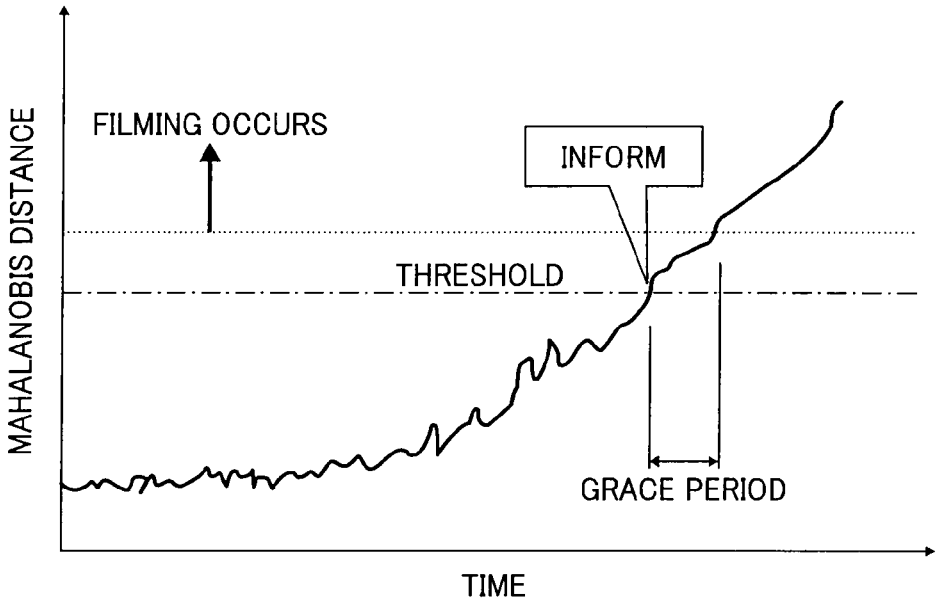
FIG. 15 is a graph of a Mahalanobis distance that changes with time.

The prediction of the filming occurrence timing can be performed based on a determination index by multiple regression analysis or Mahalanobis distance being a determination index. For example, when Mahalanobis distance is used, a combination of the relative intensity of the time-decreasing sound component, the relative intensity of the time-increasing sound component, and the relative index ratio is sampled regularly for at least one cleaning blade in a period from a brand-new point to a grace period described later, and sampled data is stored as a normal data group in a flash memory. A Mahalanobis distance D is calculated based on the normal data group and combinations of the relative intensity of the time-decreasing sound component, the relative intensity of the time-increasing sound component, and the relative index ratio obtained during an operation, and by comparing a resultant with a threshold, the filming occurrence timing can be predicted. The Mahalanobis distance D gradually increases, as shown in FIG. 15, as normality of an actual data set (combination of the relative intensity ratio and the like) to be compared with the normal data group decreases. Therefore, combinations of data sampled in a period from the brand-new point to a point of time (hereinafter, "grace-period starting point") reached going back as long as the grace time from the point of time at which filming has started is used as the normal group. Furthermore, the Mahalanobis distance D is calculated based on the normal data group and the actual data set at the grace-period starting point, and an obtained value is set as a threshold. By thus setting the threshold, the Mahalanobis distance D exceeds the threshold at the earlier point of time than the point of time at which filming occur for about time corresponding to the grace period, it is possible to predict the filming occurrence timing leaving some time until the actual occurrence.

Figure 16:
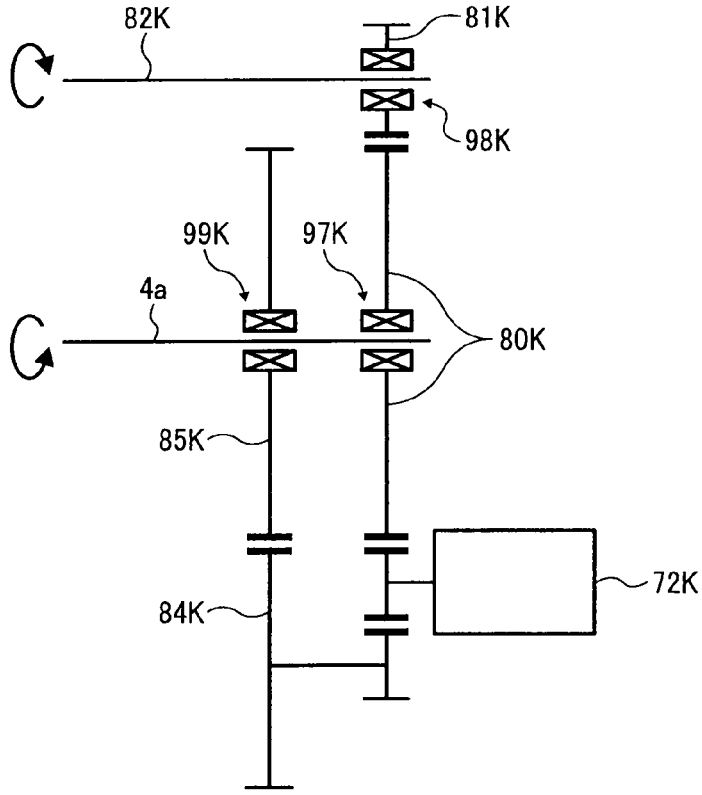
FIG. 16 is a connection diagram of a driving transmission mechanism of the process unit for K (black) in a modified device of the copier according to the embodiment.

FIG. 16 is a connection diagram of a driving transmission mechanism of the process unit for K in a modified device of the copier according to the embodiment. In the modified device, the process driving motor 72 is coupled to the third driving transmission system 82K that transmits driving force to the cleaning brush roller 17, the electric field roller 18, and the collecting screw 20, through a second one-way clutch 98K, the second driving transmission system 81K, and the first driving transmission system 80K. The first driving transmission system 80K also transmits driving force to a first one-way clutch 97K besides the second driving transmission system 81K. The first one-way clutch 97K is to transmit driving to the rotation axis 4*a* of the photoconductor.

To the rotation axis 4*a*, in addition to the first one-way clutch 97K, a third one-way clutch 99K transmits driving force. To the third one-way clutch 99K, the K process driving motor 72K is connected through a fifth driving transmission system 85K and a fourth driving transmission system 84K.

In a regular print job, the control unit controls the K process driving motor 72K to rotate in a clockwise (CW) direction. When the K process driving motor 72K rotates in the CW direction, the first driving transmission system 80K rotates in a counterclockwise (CCW) direction. Receiving this driving force, the first one-way clutch 97K transmits driving force to the rotation axis 4*a* of the photoconductor, to rotate the rotation axis 4*a* in the CCW direction. Thus, the photoconductor is rotated. Moreover, the second driving transmission system 81K transmits driving force to the second one-way clutch 98K while rotating in the CW direction with the driving force received from the first driving transmission system. In a state where the second driving transmission system 81K is rotating in the CW direction, the second one-way clutch 98K transmits driving force to the third driving transmission system 82K. Thus, the surrounding members are driven to rotate.

To the K process driving motor 72K, the fourth driving transmission system 84K is also connected besides the first driving transmission system 80K. When the K process driving motor 72K rotates in the CW direction, by the effect of this rotation, the fourth driving transmission system 84K rotates in the CCW direction. Further, by the effect of this rotation, the fifth driving transmission system 85K rotates in the CW direction. In a state where the fifth driving transmission system 85K is thus rotating in the CW direction, the third one-way clutch 99K does not transmit driving force to the rotation axis 4*a*.

That is, when the K process driving motor 72K rotates in the CW direction, driving force is transmitted to the surrounding members by a route formed with the first driving transmission system 80K, the second driving transmission system 81K, and the second one-way clutch 98K. Moreover, driving force is transmitted to the rotation axis 4*a* by a route formed with the first driving transmission system, the second driving transmission system 81K, and the first one-way clutch 97K. Although the fourth driving transmission system 84K and the fifth driving transmission system 85K also rotate at this time, driving force of these systems are not transmitted to the rotation axis 4*a* because the third one-way clutch 99K rotates idle.

On the other hand, when the determination-sound acquiring control is being conducted, the control unit controls the K process driving motor 72K to rotate in the CCW direction. When the K process driving motor 72K rotates in the CCW direction, the first driving transmission system 80K rotates in the CW direction. In this state, the first one-way clutch 97K rotates idle without transmitting driving force to the rotation axis 4*a*. Furthermore, although the second driving transmission system 81K rotates in the CCW direction by the effect of the ration of the first driving transmission system 80K in the CW direction, in this state, the second one-way clutch 98K rotates idle without transmitting driving force to the third driving transmission system.

When the K process driving motor 72K rotates in the CCW direction, the first driving transmission system 80K rotates in the CW direction as described above, as well as the fourth driving transmission system 84K rotates in the CW direction. The fifth driving transmission system 85K that receives this rotation rotates in the CCW direction. In this state, the third one-way clutch 99K transmits driving force to the rotation axis 4*a* to make the rotation axis 4*a* rotate in the CCW direction.

That is, when the K process driving motor 72K rotates in the CCW direction, by the route formed with the fourth driving transmission system 84K, the fifth driving transmission system 85K, and the third one-way clutch 99K, driving force is transmitted to the rotation axis 4*a*, and the rotation axis 4*a* rotates in the CCW direction. At this time, the first one-way clutch 97K and the second one-way clutch 98K rotate idle without transmitting driving force to the rotation axis 4*a* and the third driving transmission system 82K. Therefore, the surrounding members are not driven.

Next, copiers according to a few concrete examples in which characteristic functions are further added to the copier according to the embodiment are explained below. Unless otherwise specified, the configuration of the copier according to each example is the same as that according to the embodiment.

Figure 17:
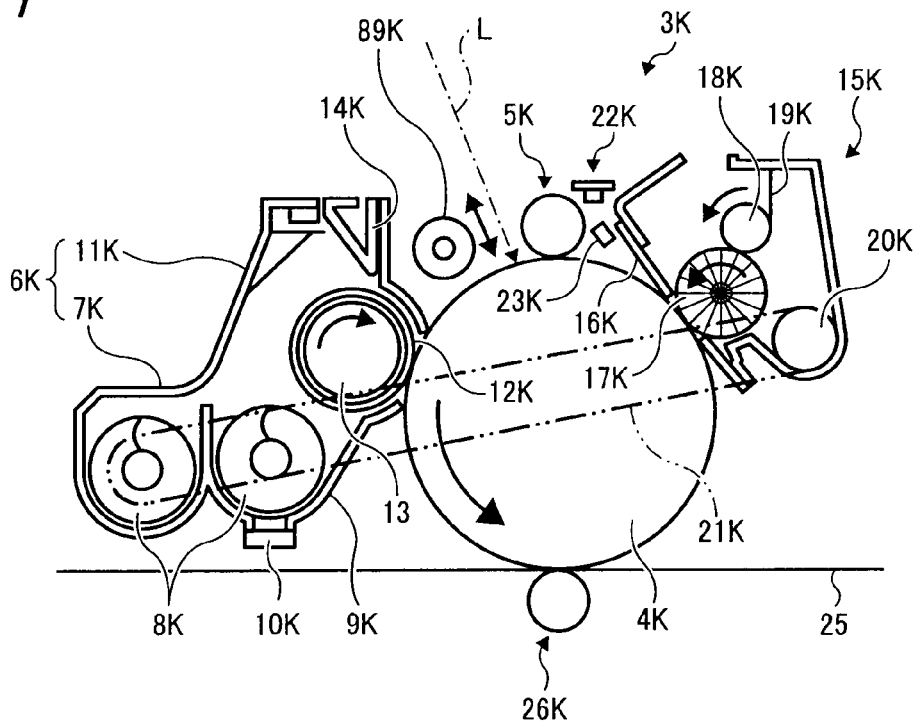
FIG. 17 is an enlarged configuration diagram of a process unit for K of a copier according to a first concrete example.

FIG. 17 is an enlarged configuration diagram of the process unit 3K for K of a copier according to a first concrete example. The process unit for K includes a filming removing roller 89K that is arranged near the photoconductor 4K. The filming removing roller 89K includes a metallic axis that is supported by a bearing in a rotatable manner, and a roller that is formed with a melamine foam fixed around the axis. The melamine foam is a material obtained by foaming melamine resin, and has a number of bubbles and a frame structure covering them. With fibriform frame structure covering the bubbles, an adhered substance can be favorably scraped away. The filming removing roller 89K formed with such melamine foam can well remove filming on the photoconductor 4K by rubbing the photoconductor 4K while rotating. However, rubbing for a long time wears the surface of the photoconductor.

In the copier according to the first concrete example, a moving mechanism that moves the bearing holding the filming removing roller 89K by driving of a solenoid (not shown) is provided. By switching on and off of driving of the solenoid, the filming removing roller 89K is brought into contact or separated with and from the photoconductor 4.

The control unit 75 performs a following removal process when it is predicted that filming occurs soon for the photoconductor 4K of the process unit 3K for K. That is a process that the filming removing roller 89K is brought into contact with the photoconductor 4K for a predetermined time period and rotated in a counter direction to the photoconductor 4 by the driving of the solenoid. When there is a high possibility of the occurrence of filming by performing this process for a predetermined time period, filming can be effectively removed while suppressing wear of the photoconductor 4K. The process units for Y, C, and M also have the similar configuration as that for K.

In a copier according to a second concrete example, a resonance tube is provided that amplifies at least one of the time-decreasing sound component and the time-increasing sound component by resonance. In the resonance tube, sound having what frequency resonates is determined depending on length L1 thereof. Specifically, the length L1 of the resonance tube can be expressed as $L1=\lambda/4=(V/f)/4$ when a speed of sound is V (346.8 m/sec, at 25° C.), a resonance frequency is f, and wavelength is $\lambda$. When the resonance frequency f is 11600 hertz corresponding to a frequency of the time-decreasing sound component, the length L1 of the resonance tube is 7.5 millimeters. Furthermore, when the resonance frequency f is 4600 Hertz corresponding to a frequency of the time-increasing sound component, the length L1 of the resonance tube is 18.8 millimeters.

By arranging such a resonance tube near the sound sensor, the intensity of the time-decreasing sound component and the time-increasing sound component can be doubled.

In this copier, an acceleration sensor or a condenser microphone that responds to sound pressure is used as the sound sensor. These devices can be manufactured in an ultra-compact size at low cost by recent MEMS technology, and the layout therefor is easy.

Figure 18:
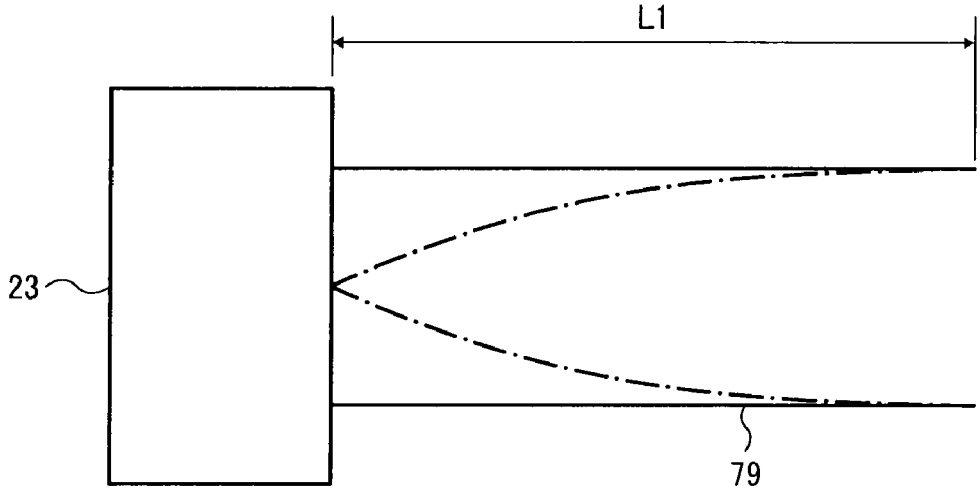
FIG. 18 is a schematic diagram of a resonance tube and a sound sensor that are used in a copier according to a second concrete example.

When a sound sensor that responds to sound pressure is used, the sound sensor 23 is arranged so as to close one end of a resonance tube 79 whose two ends are open with a sound detecting surface of the sound sensor 23, to make the sound detecting surface function as a reflection surface in the resonance tube 79. With this configuration, a steady sound wave in which the sound pressure is maximized (minimum speed) near the reflection surface and minimized (maximum speed) near the open end of the tube can be generated in the tube (a dash-dotted line in FIG. 18 indicates a velocity amplitude of the steady sound wave). Therefore in this copier, the sound sensor 23 is fixed to the resonance tube 79 as shown in FIG. 18.

In such a configuration, by amplifying the time-decreasing sound component and the time-increasing sound component, accuracy in detection therefor is enhanced and a traveling direction of sound to the sound sensor 23 is limited, thereby reducing other noise to be mixed.

Figure 19:
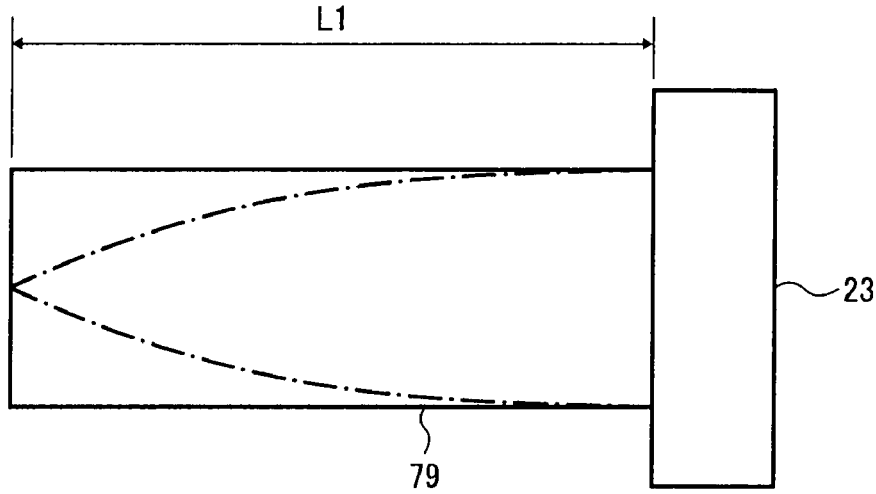
FIG. 19 is a schematic diagram of a resonance tube and a sound sensor that are used in a copier according to a third concrete example.

Also in a copier according to a third concrete example, the resonance tube is arranged near the sound sensor. Moreover, in this copier, one that responds to speed (for example, a ribbon microphone) is used as the sound sensor. As the resonance tube 79, a tube having a closed end at one end and an open end at the other end as shown in FIG. 19 is used. The sound sensor 23 is arranged in such a manner that the sound detecting surface is positioned at the side of the opening end of the resonance tub 79. Although shown as the sound detecting surface of the sound sensor 23 closes the opening end of the resonance tube 79 for convenience, the sound detecting surface is open in the actual state, and a ribbon oscillator is arranged inside the sensor. By thus arranging the sound sensor 23, the sound sensor 23 can detect sound at a position at which the sound speed is maximized inside the tube.

Figure 20:
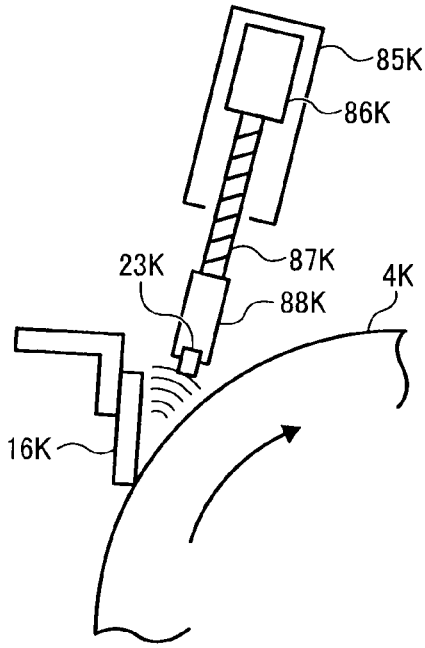
FIG. 20 is an enlarged configuration diagram of a cleaning blade for K and a peripheral configuration thereof in a copier according to a fourth concrete example.

In a copier according to a fourth concrete example, a sensor moving unit that moves the sound sensor is provided for each of the colors K, Y, C, and M. FIG. 20 is an enlarged configuration diagram of a cleaning blade 16K for K and a peripheral configuration thereof in the copier according to the fourth concrete example. As shown in FIG. 20, the sensor moving unit that moves the sound sensor includes a screw driving motor 86K, a lead screw 87K, a holder 88K, and the like.

The K sound sensor 23K is held by the holder 88K. The holder 88K is engaged with the lead screw 87K that is fixed to a rotation axis of the screw driving motor 86K. Furthermore, a base side of the screw driving motor 86K and the lead screw 87K is housed in a dust-proof casing 85K'. In a state shown in FIG. 20, the holder 88K is positioned at an end of the lead screw 87K. In this state, the K sound sensor 23K that is held by the holder 88K is positioned near the cleaning blade 16K (sound acquiring position), thereby acquiring blade rubbing noise well.

When the lead screw 87K is reverse-rotated by the screw driving motor 86K, the holder 88K moves on the screw from a screw end side toward the base side, and then is housed in the dust-proof casing 85K' (retraction position). Furthermore, when the lead screw 87K is forward-rotated by the screw driving motor 86K from this state, the holder 88K moves on the screw from a screw base side to the end side, and then moves out of the dust-proof casing 85K' to reach the sound acquiring position described above.

The control unit 75 puts the K sound sensor 23K that has been at the sound acquiring position into the dust-proof casing 85K' by reverse-rotating the screw driving motor 86K for a predetermined time at the final process in the determination-sound acquiring control (at this time, the sound sensors for Y, C, and M are also housed in the dust-proof casing). Furthermore, at the beginning of the determination-sound acquiring control, the control unit 75 moves the K sound sensor 23K that has been inside the dust-proof casing 85K' to the sound acquiring position by forward-rotating the screw driving motor 86K for a predetermined time (at this time, the sound sensors for Y, C, and M are also moved to the sound acquiring position). As described above, only when the determination-sound acquiring control is being conducted, the sound sensor is moved to the sound acquiring position, and when the determination-sound acquiring control is not conducted, the sound sensor is housed in the dust-proof casing.

In such a configuration, when it is not necessary to acquire blade rubbing noise, the sound sensor is retracted in a retraction position from a position close to the blade at which toner scatters, thereby preventing the sound sensor from being stained with toner. It is particularly effective when a condenser microphone is used as the sound sensor, because toner is likely to adhere to the sensor by accumulated electricity inside the microphone.

Figure 21:
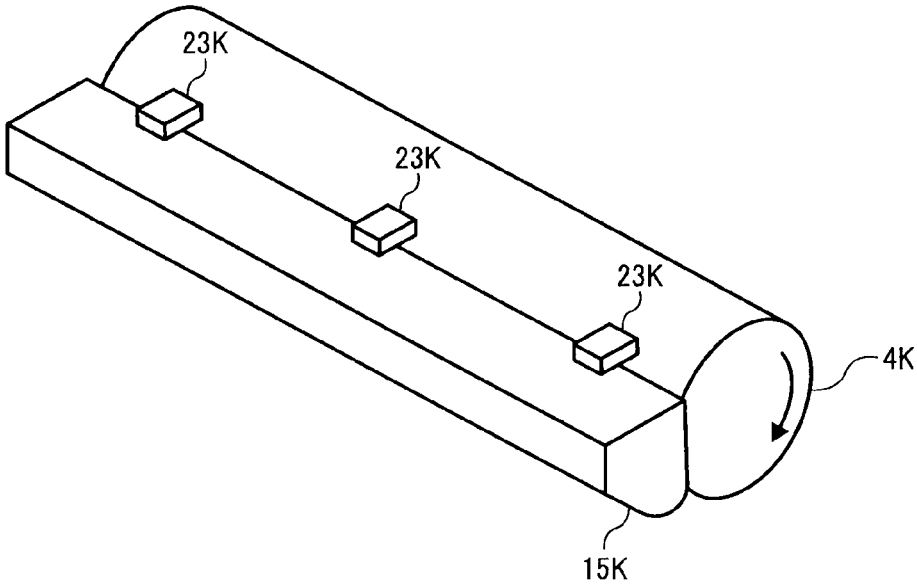
FIG. 21 is a perspective view of a photoconductor for K in a copier according to a fifth concrete example and a peripheral configuration thereof.

In a copier according to a fifth concrete example, a plurality of sound sensors are provided for each of the colors K, Y, C, and M. FIG. 21 is a perspective view of the photoconductor 4K in the copier according to the fifth concrete example and a peripheral configuration thereof. As shown in FIG. 21, inside the drum cleaning device 15K, the cleaning blade is arranged as described in the embodiment. An abutting surface (hereinafter, "blade nip") between the cleaning blade and the photoconductor 4K stretches in a direction perpendicular to a direction of surface movement of the photoconductor, that is, a direction of the axis of the photoconductor. Although the blade nip is present stretching in the direction of axis of the photoconductor, cleaning failure does not necessarily occur uniformly in the stretching direction, and cleaning failure often occurs randomly in the stretching direction. Therefore, it can be difficult to detect occurrence of cleaning failure well depending on the position of the sound sensor, because the sound sensor is too far from a position at which the cleaning failure occurs.

Therefore, in the copier, a plurality of the K sound sensors 23K are arranged along the direction of the axis of the photoconductor, which is the stretching direction of the blade nip. The control unit 75 serving as a determining unit is configured to determine whether cleaning failure has occurred separately based on acquisition results by the K sound sensors 23K. The process units for Y, C, and M also have the similar configuration.

With such a configuration, it is possible to avoid degradation of detection accuracy for cleaning failure caused because the sound sensor is positioned too far from a position at which the cleaning failure occurs.

Figure 22:
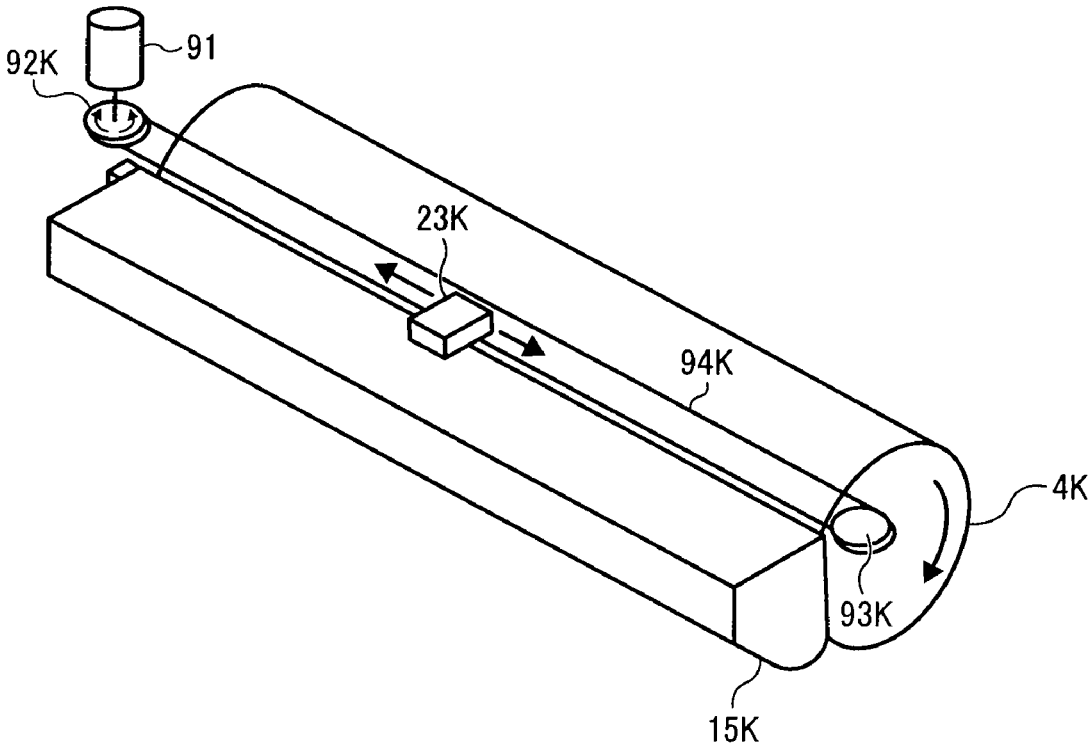
FIG. 22 is a perspective view of a photoconductor for K in a copier according to a sixth concrete example and a peripheral configuration thereof.

In a copier according to a sixth concrete example, a sensor moving unit that moves the sound sensor, for each of the colors of K, Y, C, and M. FIG. 22 is a perspective view of the photoconductor for K in the copier according to the sixth concrete example and a peripheral configuration thereof. As shown in FIG. 22, the sensor moving unit that moves the sound sensor includes a belt driving motor 91K, a first pulley 92K, a second pulley 92K, an endless timing belt 94K, and the like.

The endless timing belt 94K is held in a stretched state along the direction of axis of the photoconductor by being wound around the first pulley 92K and the second pulley 93K. The first pulley 92K is fixed to a motor axis of the belt driving motor 91K. Therefore, when the belt driving motor 91K rotates in a forward direction, the endless timing belt 94K moves endlessly in the forward direction. Moreover, when the belt driving motor 91K moves endlessly in a reverse direction, the endless timing belt 94K moves endlessly in the reverse direction.

The K sound sensor 23K is fixed to the endless timing belt 94K, and moves in the direction of the axis of the photoconductor along with the endless movement of the endless timing belt 94K. The process units for Y, C, and M also have the similar configuration.

The control unit 75 moves the K sound sensor 23K to a position opposite to one end of the photoconductor 4K reverse-rotating the belt driving motor 91K for a predetermined time at the final process in the determination-sound acquiring control. At this time, each of the sound sensors for Y, C, and M is also moved to a position opposite to one end of the photoconductor similarly. Furthermore, at the beginning of the determination-sound acquiring control, a following process is repeated. After the K sound sensor 23K is moved a little toward the other end in the direction of the axis of the photoconductor by forward-rotating the belt driving motor 91K for a predetermined time, rubbing noise is acquired. By repeating such a process for several times, the K sound sensor 23K acquires blade rubbing noise that is generated at different positions in the direction of axis of the photoconductor. Such a process is performed similarly in the process units for Y, C, and M. Whether cleaning failure has occurred is determined separately based on the blade rubbing noise acquired at different positions in the direction of axis of the photoconductor.

Also with such a configuration, it is possible to avoid degradation of detection accuracy for cleaning failure caused because the sound sensor is positioned too far from a position at which the cleaning failure occurs.

Although an example of detecting cleaning failure caused by deterioration of a cleaning blade that cleans toner on a photoconductor serving as an image carrier has been explained above, cleaning failure caused by deterioration of a cleaning blade as explained below can be detected. That is a cleaning blade that performs a cleaning process with respect to an image carrier different from a photoconductor, such as an intermediate transfer belt.

As described above, in the copier according to the embodiment, the A/D converter 70 serving as a converting unit that converts sound information acquired by the sound sensor into electronic data, and a flash memory serving as a storage unit that stores a relative intensity ratio and the like, which is sound information based on the output electronic data, are provided. Furthermore, the control unit 75 serving as a predicting unit is configured to analyze a change with time of the relative intensity ratio stored in the flash memory or a Mahalanobis distance being a specific determination index calculated based on the relative intensity, and to predict a filming occurrence timing based on a result of analysis. With such a configuration, by informing a user, before the occurrence of filming, that filming occurs shortly, a preparation period for replacement of cleaning blade is given, and a swift replacement of blade at the time of the occurrence of filming can be achieved.

Moreover, in the copier according to the first concrete example, the filming removing roller 89K as a filming removing unit that can contact with and separate from the photoconductor 4K and that removes filming formed on the photoconductor 4K in a state where the filming removing roller 89K contact the photoconductor 4K is provided. Further, the control unit 75 serving as a control unit is configured to perform a filming removal process by making the filming removing roller 89K abut against the photoconductor 4K for a predetermined time when it is predicted that filming occurs shortly. With such a configuration, only when there is a high possibility of the occurrence of filming, the removal process by the filming removing roller 89K is performed, thereby suppressing wear of the photoconductor 4K caused by the filming removing roller 89K, and avoiding various kinds of failures due to the occurrence of filming.

Furthermore, in the copier according to the embodiment, the control unit 75 being a control unit is configured to conduct, at a predetermined timing, the determination-sound acquiring control in which the photoconductor is driven in a state where driving of the surrounding members (the cleaning brush roller, the electric field roller, and the collecting screw) that perform specific operations around the blade is stopped to make the sound sensor (23K, 23Y, 23C, 23M) acquire sound used for determination whether cleaning failure has occurred. Furthermore, the control unit 75 serving as a determining unit is configured to determine whether cleaning failure has occurred based on sound acquired by the sound sensor during the determination-sound acquiring control. With such a configuration, it is possible to avoid degradation of determination accuracy caused by operation sound of the surrounding members mixed to the blade rubbing noise.

Moreover, in the copier according to the embodiment, the driving transmission system is configured to drive the photoconductor and the above surrounding members by the same process driving motors (72K, 72Y, 72C, 72M), and the electromagnetic clutch (73K, 73Y, 73C, 73M) of a normally closed type that transmits driving force of the process driving motor to the surrounding members in a non-energized state and that shuts transmission of driving force to the surrounding members in an energized state is provided in the driving transmission system. With such a configuration, by driving the photoconductor and the surrounding members by the same process driving motor, configuration is simplified, and by controlling on and off of the transmission of the driving force to the surrounding members by the electromagnetic clutch, the driving of the surrounding members can be stopped while the photoconductor is driven during the determination-sound acquiring control. Furthermore, if a normally closed type is applied as the electromagnetic clutch, by controlling the electromagnetic clutch not to be energized during an image forming operation that accounts most of accumulated driving time of the process driving motor, it can be configured to save energy and to make the life of the clutch longer.

Furthermore, in the modified device, the photoconductor and the above surrounding members are driven by the same process driving motors, and the driving transmission system is configured to transmit the driving force of the process driving motor to both the photoconductor and the surrounding members during forward rotation of the process driving motor, and to transmit the driving force of the process driving motor only to the photoconductor during reverse rotation of the process driving motor. With such a configuration, by driving the photoconductor and the surrounding members by the same process driving motor, simplification of configuration is achieved, and the driving of the surrounding members can be stopped while the photoconductor is driven during the determination-sound acquiring control. Furthermore, without preparing a special driving unit such as an electromagnetic clutch, the driving of the surrounding members can be stopped while the photoconductor is driven.

Moreover, in the copier according to the second concrete example and the third concrete example, the resonance tube 79 that resonates with at least one of 11.5 kilohertz to 11.7 kilohertz as a first frequency and 4.5 kilohertz to 4.7 kilohertz as a second frequency is provided, and the sound sensor 23 is connected to the resonance tube 79 or arranged near the resonance tube 79. With such a configuration, by amplifying the time-decreasing sound component and the time-increasing sound component, detection accuracy thereof can be enhanced.

Furthermore, in the copier according to the second concrete example, as the sound sensor 23, one that responds to sound pressure is used, and the sound sensor 23 is used as a reflection surface of the resonance tube 79. With such a configuration, the sound sensor 23 can detect the time-decreasing sound component and the time-increasing sound component at a position at which the sound pressure of the time-decreasing sound component and the time-increasing sound component is maximized in the resonance tube 79. In addition, by limiting the traveling direction of the sound components to the sound sensor 23, mixture of other noises can be reduced.

Moreover, in the copier according to the third concrete example, as the sound sensor 23, one that responds to sound speed is used, and the sound sensor 23 is arranged at a side of the opening end of the resonance tube 79. With such a configuration, the sound sensor 23 can detect the time-decreasing sound component and the time-increasing sound component at a position at which the sound speed of the time-decreasing sound component and the time-increasing sound component is maximized near the resonance tube 79.

Furthermore, in the copier according to the fourth concrete example, a sensor moving unit is provided that moves the K sound sensor 23K between the sound acquiring position at which sound generated at the abutting part between the cleaning blade 16K and the photoconductor 4K is acquired and the retraction position that is positioned farther than the sound acquiring position from the abutting part. With such a configuration, when it is not necessary to acquire blade rubbing noise, the sound sensor is retracted in the retraction position from a position close to the blade at which toner scatters, thereby preventing the sound sensor from being stained with toner.

Moreover, in the copier according to the fifth concrete example, a plurality of the K sound sensors 23K are arranged along the direction perpendicular to the direction of the surface movement of the photoconductor at the abutting surface between the cleaning blade and the photoconductor 4K, and the control unit 75 is configured to determine whether cleaning failure has occurred separately based on results acquired by the respective K sound sensors 23K. With such a configuration, it is possible to avoid degradation of detection accuracy for cleaning failure caused because the sound sensor is positioned too far from a position at which the cleaning failure occurs.

Furthermore, in the copier according to the sixth concrete example, the sensor moving unit is provided that moves the K sound sensor 23K in a movement perpendicular direction that is the direction perpendicular to the direction of surface movement of the photoconductor, at the abutting surface between the cleaning blade and the photoconductor 4K. In addition, the control unit 75 is configured to determine whether cleaning failure has occurred separately based on at least results acquired by the sound sensor moved to a first position in the movement perpendicular direction (the direction of axis of the photoconductor) and by the sound sensor moved to a second position in the movement perpendicular direction. With such a configuration also, it is possible to avoid degradation of detection accuracy for cleaning failure caused because the sound sensor is positioned too far from a position at which the cleaning failure occurs.

According to the present invention, the occurrence of cleaning failure can be accurately detected.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image carrier that carries a toner image;

a transfer unit that transfers the toner image from a surface of the image carrier to a transfer medium;

a cleaning blade that cleans residual toner adhered on the surface while abutting with the surface that has passed the transfer unit;

a sound sensor that collects a sound generated inside a casing of the image forming apparatus; and a determining unit that determines, based on the sound collected by the sound sensor, whether cleaning failure has occurred in the cleaning blade based on at least intensity of a first sound component that is a sound component of a first frequency and intensity of a second sound component that is a sound component of a second frequency different from the first frequency.

2. The image forming apparatus according to claim 1, further comprising:

a converting unit that converts the sound collected by the sound sensor into electronic data;

a storage unit that stores therein the electronic data; and a predicting unit that analyzes, by using the electronic data in the storage unit, any one of a change of the intensity of the first sound component and the second sound component with time and a specific determination index that is calculated based on each intensity of the first sound component and the second sound component, and predicts a timing at which filming might occur on the image carrier based on a result of the analysis.

3. The image forming apparatus according to claim 2, further comprising:

a filming removing unit that can contact with and separate from the image carrier, and that removes filming formed on the image carrier in a state where the filming removing unit is in contact with the image carrier; and a control unit that performs a filming removal process by controlling the filming removing unit to contact with the image carrier for a predetermined time when the predicting unit predicts that filming is going to occur shortly.

4. The image forming apparatus according to claim 2, wherein the first sound component is a sound component whose intensity decreases with time in a period in which a brand-new cleaning blade becomes deteriorated to an extent to cause the cleaning failure, and the second sound component is a sound component whose intensity increases with time in the period, and the predicting unit is configured to predict, by analyzing the changes with time, that filming occurs shortly based on detection of a change of behavior of the intensity of the first sound component from decrease with time to increase with time after the determining unit detects that the cleaning failure has occurred and a change of behavior of the intensity of the second sound component from increase with time to decrease with time after the determining unit detects that the cleaning failure has occurred.

5. The image forming apparatus according to claim 2, wherein the predicting unit is configured to analyze a Mahalanobis distance as the determination index.

6. The image forming apparatus according to claim 1, further comprising a control unit that performs, at a predetermined timing, a determination-sound acquiring control in which the image carrier is driven while driving of surrounding members that performs specific operations around the cleaning blade is stopped to cause the sound sensor collect the sound used for determination whether the cleaning failure has occurred, wherein the determining unit is configured to determine whether cleaning failure has occurred based on the sound collected by the sound sensor during the determination-sound acquiring control.

7. The image forming apparatus according to claim 6, further comprising a driving transmission system that is configured to drive the image carrier and the surrounding members with a common driving motor, and that includes an electromagnetic clutch of normally closed type that transmits driving force of the driving motor to the surrounding members in a non-energized state and shuts transmission of driving force to the surrounding members in an energized state.

8. The image forming apparatus according to claim 6, further comprising a driving transmission system that is configured to drive the image carrier and the surrounding members with a common driving motor, and that transmits driving force of the driving motor to both the image carrier and the surrounding members when the driving motor rotates in a predetermined direction, and that transmits driving force of the driving motor only to the image carrier out of the image carrier and the surrounding members when the driving motor rotates in an opposite direction to the predetermined direction.

9. The image forming apparatus according to claim 1, further comprising a resonance tube that resonates with at least one of sounds having the first frequency and the second frequency, wherein the sound sensor is connected to the resonance tube or arranged near the resonance tube.

10. The image forming apparatus according to claim 9, wherein the sound sensor is a sensor that responds to sound pressure, and the sound sensor is used as a reflection surface of the resonance tube.

11. The image forming apparatus according to claim 9, wherein the sound sensor is a sensor that responds to sound speed, and the sound sensor is arranged near an opening end of the resonance tube.

12. The image forming apparatus according to claim 1, further comprising a sensor moving unit that moves the sound sensor between a sound collecting position to acquire sound that is generated at an abutting part between the cleaning blade and the image carrier and a retraction position that is positioned farther from the abutting part than the sound collecting position.

13. The image forming apparatus according to claim 1, wherein the sound sensor is arranged in plural along a direction perpendicular to a surface movement direction of the image carrier on an abutting surface between the cleaning blade and the image carrier, and the determining unit is configured to determine whether the cleaning failure has occurred separately based on a sound collected by each of the sound sensors.

14. The image forming apparatus according to claim 1, further comprising a sensor moving unit that moves the sound sensor along a movement perpendicular direction that is a direction perpendicular to surface movement of the image carrier on an abutting surface between the cleaning blade and the image carrier, wherein the determining unit is configured to determine whether the cleaning failure has occurred separately based on at least a sound collected by the sound sensor moved to a first position in the movement perpendicular direction and a sound collected by the sound sensor moved to a second position in the movement perpendicular direction.

15. The image forming apparatus according to claim 1, wherein the first sound component is a sound component whose intensity decreases with time in a period in which a brand-new cleaning blade becomes deteriorated to an extent to cause the cleaning failure, and the second sound component is a sound component whose intensity increases with time in the period, and the determining unit is configured to determine whether the cleaning failure has occurred based on a comparison between a ratio of the intensity of the first sound component and the intensity of the second sound component and a predetermined threshold.

* * * * *